United States Patent [19]

Rutter et al.

[11] Patent Number: 4,981,374

[45] Date of Patent: Jan. 1, 1991

[54] PLASTIC BAGS CARRIED IN A CONTINUOUS WEB

[75] Inventors: Christopher C. Rutter, Oakland; Robert A. Bilbrey, Orinda; Bruce R. Koball, Berkeley, all of Calif.

[73] Assignee: Rapak, Inc., Hayward, Calif.

[21] Appl. No.: 252,058

[22] Filed: Sep. 30, 1988

[51] Int. Cl.[5] ..... B65D 30/10

[52] U.S. Cl. ..... 383/37; 206/621; 383/66; 383/904; 383/121; 383/903

[58] Field of Search ..... 206/390, 621; 383/37, 383/66, 44, 904, 121, 903; 229/69

[56] References Cited

U.S. PATENT DOCUMENTS

| | | | |
|---|---|---|---|
| 2,990,101 | 6/1961 | Mead et al. | 206/620 |
| 3,027,065 | 3/1962 | Lindquist et al. | 383/37 |
| 3,186,625 | 6/1965 | Mead et al. | 383/37 |
| 3,313,472 | 4/1967 | Tjerneld et al. | 383/44 |
| 3,337,117 | 8/1967 | Lehmacher et al. | 383/44 |
| 3,900,160 | 8/1975 | Goto et al. | 229/67 |
| 3,948,015 | 4/1976 | Lerner . | |
| 3,960,062 | 6/1976 | Leloux | 206/390 |
| 3,990,625 | 11/1976 | Jelling et al. | 206/390 |
| 4,464,790 | 8/1984 | Blankenship | 383/37 |
| 4,508,224 | 4/1985 | Weber et al. | 229/67 |

FOREIGN PATENT DOCUMENTS

| | | | |
|---|---|---|---|
| 568472A | 6/1954 | Belgium . | |
| 0064321A1 | 11/1982 | European Pat. Off. . | |
| 730235 | 5/1955 | United Kingdom | 383/44 |

*Primary Examiner*—Stephen P. Garbe

*Attorney, Agent, or Firm*—Majestic, Parsons, Siebert & Hsue

[57] ABSTRACT

A machine for automatically filling plastic bags with liquid or particulate material moves a continuous web of such bags through a number of serially positioned work stations. The bags are completely sealed when they enter the machine. As each bag passes through a slitting work station, a specially shaped opening is cut into the bag near an end of it which will become its top. When the bag proceeds to a filling work station, it is held vertically and a specially shaped fill nozzle is moved downward and rotated for entry into the bag through the slit opening. A valve is provided within the fill nozzle for controlling entry of the material into the bag. The valve and fill nozzle are cooperatively controlled by a single mechanism. The bags are transported through the various work stations by a positive toothed belt drive that preferably holds the bags flat until the filling station, wherein the belts are then moveable toward and away from each other in order to allow filling of the bag. After filling, the bag opening is then sealed. The various techniques are especially useful for aseptic packaging of foods, such as milk and wine. Fitments for later use in removing material can also be added to the bag in another work station. The bags and fitments are structured and carried in a way to cooperate with the machine.

22 Claims, 17 Drawing Sheets

PLASTIC BAGS CARRIED IN A CONTINUOUS WEB

BACKGROUND OF THE INVENTION

This invention relates generally to machinery and techniques for packaging material, and to packages and components thereof.

The use of plastic bags and pouches has become widespread for storing and transporting material. Liquid, particles, and other forms of material are being packaged this way. A significant application is for packaging food products. As an example, wine and milk are packaged in a flexible plastic bag that is contained in a cardboard box. A dispenser attached to the bag extends through the box in order to allow manual operation of a dispenser valve to withdraw liquid from the bag.

The specific processes for forming and filling such plastic bags are many. One technique is to use a continuous roll of thin plastic material that is formed into a tube by a filling machine, sealed along its length to form a tube, and then periodically sealed by a filling machine across its width. Material to be packaged is placed in the tube at the sealed location, and its top is then sealed. The formed and filled bag is then cut away from the rest of the continuous tube to provide a sealed package of material. A dispenser is optionally attached to the outside of the bag, depending upon the particular application.

Another technique is to first, before filling, form sealed bags from plastic material with a fill spout attached to each bag through one wall of the bag. The bag is then filled through the fill spout. Closing of the bag is achieved by attaching a dispenser to the fill spout after filling, thereby to complete the operation.

Another technique is disclosed in U.S. Pat. No. 4,598,529—Pongrass, et al. (1986). There, a continuous web of individual bags is formed from plastic sheet material in a manner that each bag is initially completely sealed. Any dispenser or fitment for a dispenser that is attached to the bag by the filling machine and is not attached through the wall of the bag. Rather, the system is of a type where the bag is punctured by the user when the dispenser is first operated to extract material from the bag. The bag is loaded by forming a slit along a portion of one end and then inserting a nozzle through the slit when the bag is held vertically. Material enters the bag through the nozzle. When the bag is full, the nozzle is withdrawn, and the bag slit is sealed.

A primary object of the present invention is to provide a bag filling technique and apparatus that improves the speed at which bags can be filled, simplifies the procedure and reduces the likelihood of malfunction.

It is another object of the present invention to provide an improved bag structure and technique for filling it.

It is another object of the present invention to provide an improved technique and apparatus for attaching to bags dispensers and/or fitments therefore.

It is yet a further object of the present invention to provide an improved apparatus and technique for aseptic filling of plastic bags.

SUMMARY OF THE INVENTION

These and additional objects are accomplished by the various aspects of the present invention, which are only briefly summarized here. As background, a continuous web of preformed, sealed plastic bags is moved through a filling machine so that each bag individually progresses through a number of work stations that perform different operations on the bag. These work stations include one to form an opening in the bag before filling and another to fill the bag. After filling, the bag is resealed and removed from the apparatus. Optionally, a dispenser or fitment therefore is attached to each bag of the continuous web. Also, optionally, a work station is provided to sterilize the bag prior to filling and to enclose at least the filling station in an aseptic environment.

According to a specific aspect of the present invention, filling is accomplished by inserting a pointed nozzle into a slit formed in one sheet of the bag. The shape of the slit and motion of a nozzle both down into the bag and rotatably about its axis causes the nozzle to be inserted into the bag with a high degree of reliability. Also, during filling, the bag is held generally in a vertical position by positively gripping its edges in a manner to move the edges back and forth toward each other to aid the process of inserting the nozzle into the bag and to keep excess air from becoming trapped in the bag.

According to another specific aspect of the present invention, the sealed bags are provided with a neck formed therein in a shape that assists entry of a nozzle through a slit provided in the neck region. The neck is formed to prevent entry of air into the bag during filing but for those situations where air does get into the bag, a region around the neck is also formed in order to encourage the escape of air through the neck during the filling procedure. The bags are attached to one another in a continuous web at a perforated seam so that they may be separated by pulling apart, thereby eliminating a cutting operation.

According to another specific aspect of the present invention, a valve is provided within the filling nozzle and both the movement of the nozzle and opening of the valve are controlled by common mechanical components that simplify the mechanism and reduce the possibility of malfunction.

According to another specific aspect of the present invention, dispensers and/or fitments therefore are supplied to the apparatus by attachment to a flexible carrier web that is positively advanced into a fitment attachment mechanism in one of the work stations, for those operations where a dispenser and/or fitment is to be attached. The carrier is weakened around the fitment so that a fitment is easily transferred from the carrier to the bag.

According to a further specific aspect of the present invention, the filled bag has liquid removed from its outside around the open slit, the bag slit is resealed by application of heat and pressure and the resealed portion of the bag cooled by mechanisms provided at the end of arms provided to grip a bag after filling and remove it from the machine.

According to yet another aspect of the present invention, aseptic filling is aided by providing a liquid bath gate, both where the bag webs are entering the filling chamber and where the filled bags are leaving the filling chamber. Between these input and output liquid bath gates, the slot cutting, filling and resealing operations are accomplished in an aseptic atmosphere.

Additional objects, advantages and features of the many aspects of the present invention will become apparent from the following description of its preferred embodiments, which description should be taken in conjunction with the accompanying drawings.

DESCRIPTION OF THE PREFERRED EMBODIMENTS

Figure 1A:
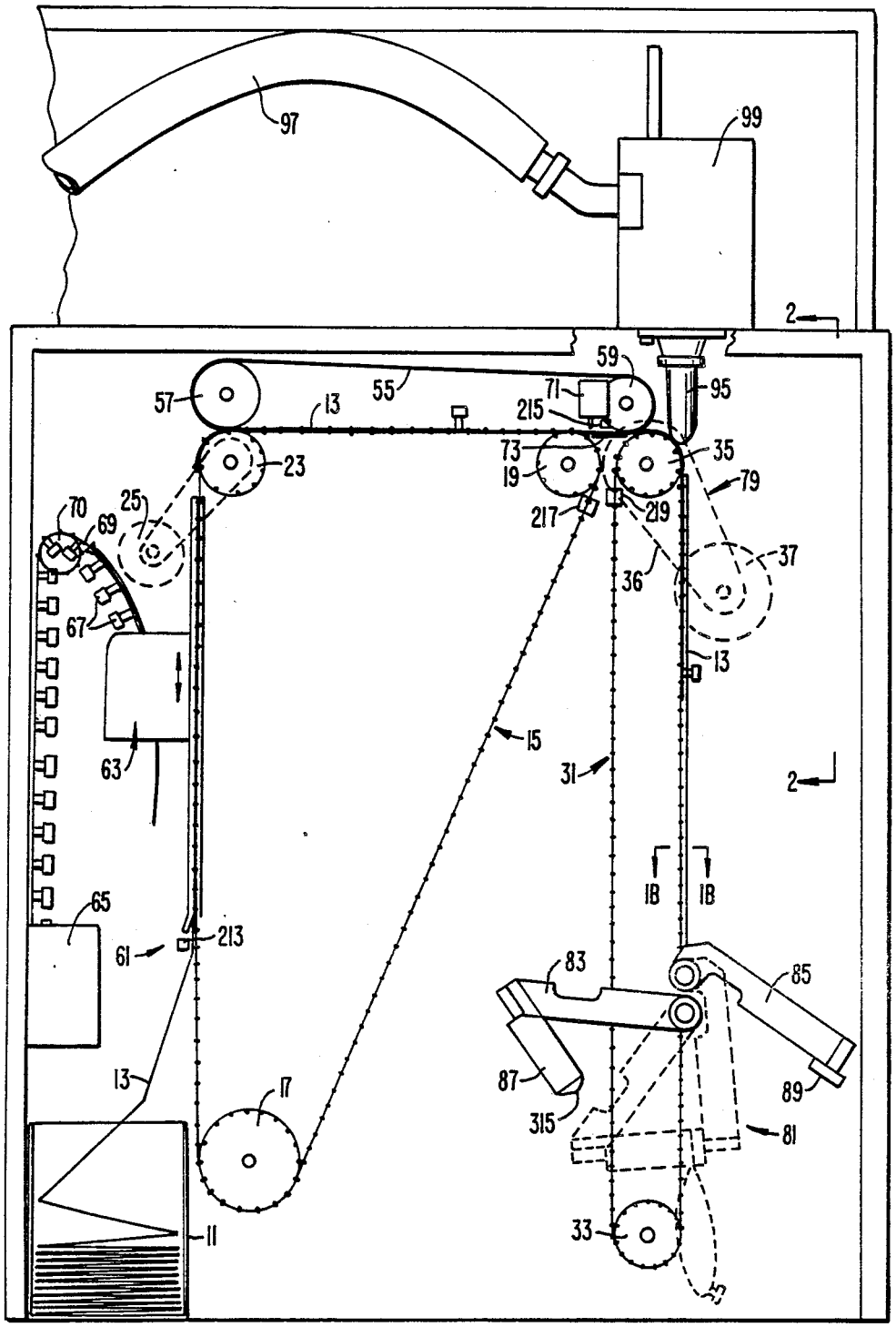
FIG. 1A is a schematic representation of a side view of a bag filling apparatus incorporating the various aspects of the present invention.

Referring initially to the side schematic view of the filling apparatus of FIG. 1A, its bag transporting mechanism and work stations are briefly described. A container 11 of a web 13 of fan-folded bags serves as an input to the process and apparatus. These preformed sealed bags are advanced through the work stations by two independently driven mechanisms. A feed tractor mechanism 15 includes a pair of spaced apart flexible toothed belts (not shown) which extend over rollers 17, 19 and 23. These toothed belts are driven by a motor source 25 which is connected to the roller 23. A similar pair of toothed belts 27 and 29 (FIG. 3) are provided as part of a second, independently driven fill tractor 31 mechanism (FIG. 1A). Belts 27 and 29 are carried by rollers 33 and 35. Roller 35 is driven by a motor 37. The motors 25 and 37 can be operated independently of each other.

Figure 1B:
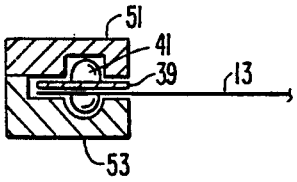
FIG. 1B is a cross sectional view of a portion of FIG. 2 taken at Section 1B—1B.
Figure 1C:
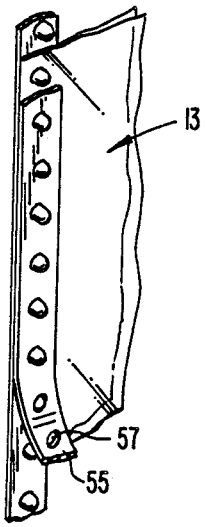
FIG. 1C shows an exploded view of a portion of the mechanism of FIG. 1A.
Figure 3:
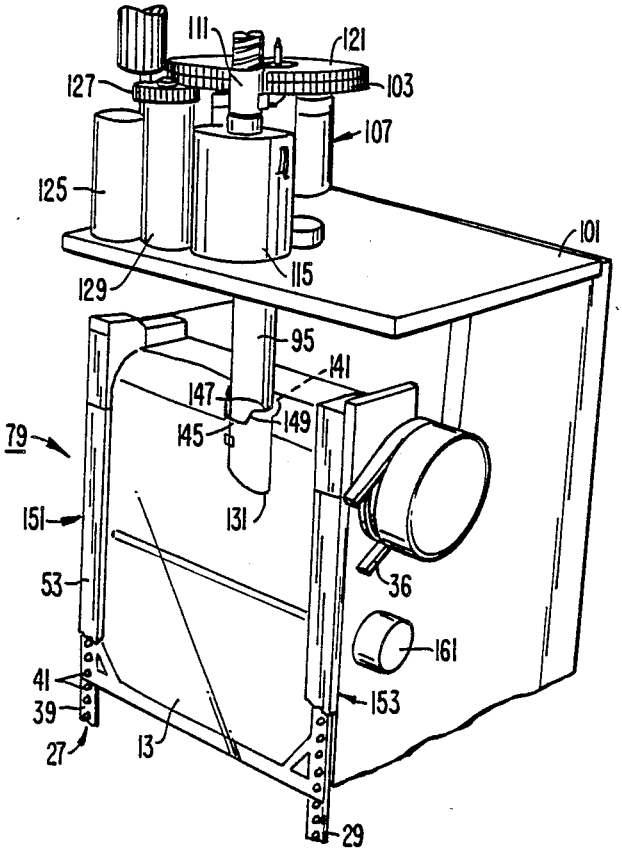
FIG. 3 is a perspective view of a portion of the apparatus of FIGS. 1–2 and including additional mechanisms.

A typical structure of a toothed belt utilized in these drive mechanisms is shown in FIGS. 1C and 3. A flexible stainless band 39 has a plurality of plastic pins 41 molded along its length at periodic intervals. With brief reference to FIG. 8, a bag web 13 of type driven by these belts is shown. Two flexible plastic sheets forming the bag web structure are welded together along opposite edges 43 and 45. In those welds are formed a plurality of periodically spaced apertures 47 and 49, respectively. The molded plastic pins of the driving belts are spaced apart the same distance as the holes of the bag web structure 13. Also, each pair of belts is separated by an amount equal to the distance between the rows of apertures 47 and 49. In the case of the feed tractor 15, alternate pins along the length of its belts may be omitted since the load of the empty bags carried thereby is not as great as the load of the filled bags carried by the belts of the fill tractor 31.

The bags are held onto the toothed belts in one of two ways, at different places in the apparatus. Referring to FIG. 1B, a cross-sectional view of the belt 39 is shown in a portion where it is travelling vertically. A belt guide 51 is provided on the back side of the belt 39 while a retaining piece 53 is provided on its other side in order to prevent the bag 13 from becoming disengaged from the belt pins 41. Each of the guide and retaining pieces 51 and 53 contain an elongated slot in which the pins 41 may freely travel as the belt 39 is moved through the structure. The same structure as shown in FIG. 1B is utilized by the first feed tractor 15 in its vertical portion which carries the bag.

A second type of bag retention system is used in a horizontal portion of the feed tractor 15. Referring to FIG. 1A, a band 55 is carried by rollers 57 and 59. The structure of the band 55 is best shown in FIG. 1C. It includes a plurality of apertures 57 periodically spaced along its length such that they are aligned with the plastic pins of a corresponding driving belt. The band 55 thus traps the bag 13 against the driving belt, as shown in FIG. 1C. Two such bands are utilized in the embodiment of 1A, of course, one positioned over each of the driving belts of the feed tractor system 15.

Figure 13A:
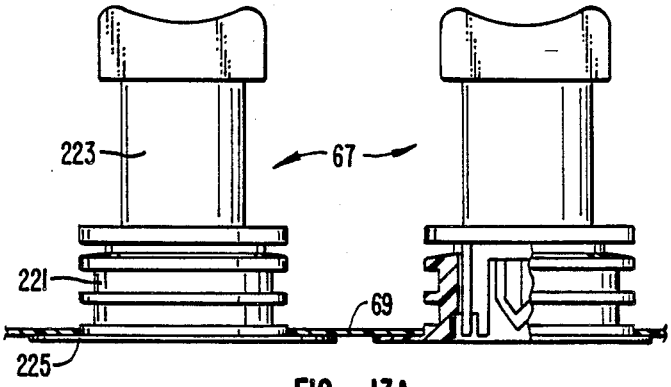
FIGS. 13A and 13B show side and top views, respectively, of a dispenser and fitment carried by a web.
Figure 13B:
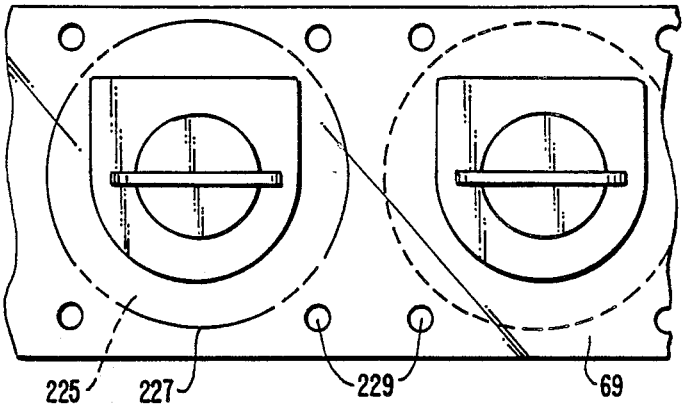

With reference again to FIG. 1A, the specific work stations illustrated in that embodiment will now be generally described. A first work station, in a region 61, effects an engagement of a bag web 13 with the driving feed tractor 15. The web is then drawn past a mechanism 63 for attaching a fitment and/or dispenser to each of the individual bags as the web of bags is drawn past. The attachment can be made by use of an adhesive or by welding, as appropriate. In some cases, neither a fitment nor a dispenser will be attached, depending upon the application. But where it is so attached, a supply 65 of fitments is provided wherein a plurality of such fitments 67 are carried by an elongated flexible web 69, as more specifically described hereinafter with respect to FIGS. 13A and 13B. The fitment attachment mechanism 63 is movable in both vertical and horizontal directions with respect to the rest of the machine in order to define the position of the fitment on each bag. It is preferable to position the mechanism 63 so that a dispenser or fitment is attached while the bag web is stopped for another operation, such as when cutting a slot in the bag or when waiting for a bag to be filled, so that both operations may be accomplished at the same time.

The next principle work station in the embodiment of FIG. 1A is a slot cutting mechanism 71 of a conventional type. A bag web is supported by a plate 73 in the transition between the feed and fill tractors 15 and 31. The mechanism 71 is provided to kiss-cut only the top layer of plastic of the bag. The details of the nature of the cut is explained hereinafter.

Either immediately before or immediately after the kiss-cutting operation, depending upon the precise location of the cutting mechanism 71, a single bag is separated from the web of bags so that it can be filled. This separation is preferably accomplished by first advancing both the feed and fill tractors 15 and 31 together until the perforated section between the bags to be separated is no longer carried by the drive belts of the feed tractor 15 and the perforations between bags is located in the transition between the feed and fill tractors. The motor 25 for the feed tractor 15 is then stopped, while the motor 37 causes the fill tractor 31 to continue to move forward with enough force to separate the leading bag of the web from the rest of the bags. It is desirable to accomplish this separation prior to filling the bag. This separation is made possible because of perforations between the bags, such as perforations 75 and 77 of the web of bags shown in FIG. 8.

The next operation is accomplished by a filling station, generally indicated at 79. Much is said about the details of the filling operation later. After the bag is filled, it proceeds downward from the fill station 79 to another station 81 where its top is clamped by swinging arms 83 and 85, as shown in dotted outline in FIG. 1A. End portions 87 and 89 of the clamping arms 83 and 85 grip opposite sides of the bag to simultaneously reseal the slit placed in one sheet of the bag by the cutting mechanism 71, and remove the bag from the fill tractor 31. The filled bag is then ready for further packaging and shipping.

Figure 9A:
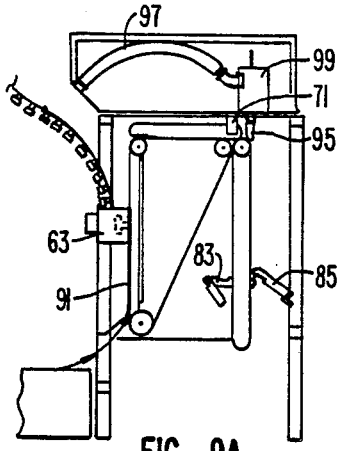
FIGS. 9A through 9E schematically illustrate the progress of a bag through the different work stations and the filling apparatus from the view of FIG. 1A.
Figure 9B:
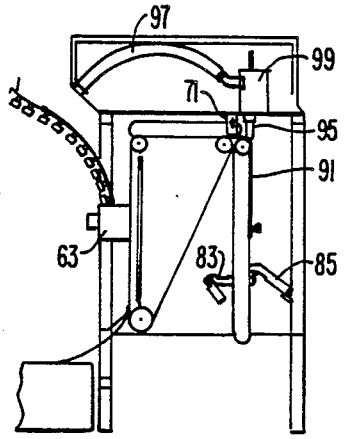

Referring to the schematic views of FIGS. 9A through 9E, movement of a single bag 91 through the various work stations is summarized. In FIG. 9A, the bag 91 is shown at the fitment attachment work station 63. Of course, in this stage, the bag 91 is attached to others in the continuous web of bags, both in front of and behind the bag 91. The entire web is stopped momentarily while a fitment is attached by the apparatus 63 to the bag 91.

The next operation on the bag 91 is to cut the slit in the bag with the cutting mechanism 71. The bag 91 is then stopped at a position shown in 9B for that operation. Between the steps of attachment of a fitment to the bag 91 and then forming its slit opening, bag 91 is likely stopped one or more times as part of a continuous web when those operations are being performed on other bags in the web.

Figure 8:
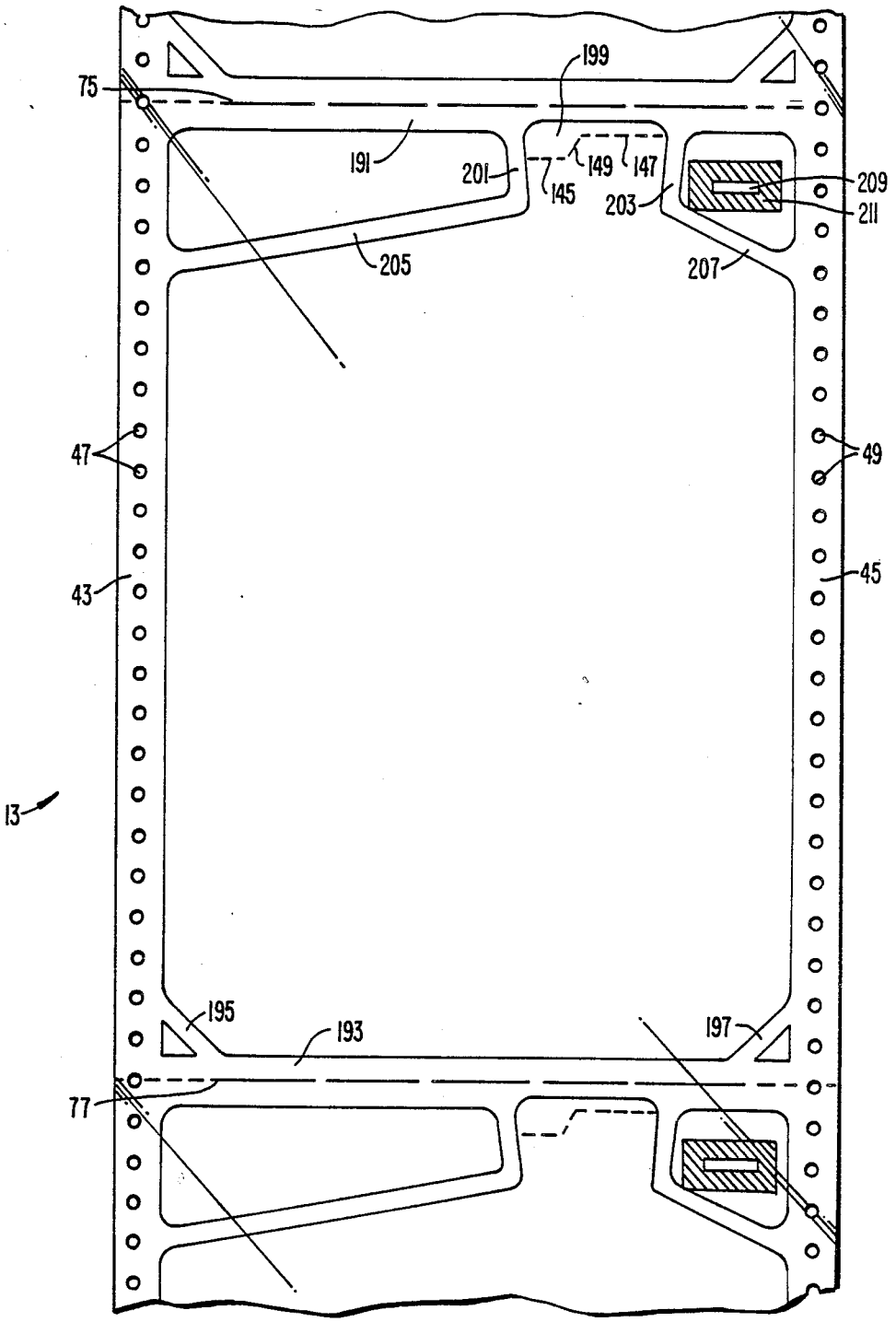
FIG. 8 illustrates a preferred bag structure for carrying out the present invention.
Figure 9C:
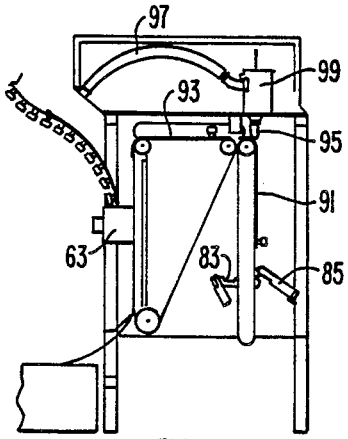

The next step, illustrated in FIG. 9C, is to separate the bag 91 from the web, particularly from a bag 93 of that web that is attached to the bag 91. This separation is accomplished by holding the feed tractors 15 stationary while applying power to the fill tractors 32 in order to separate the adjacent bags at the perforations between them (see perforations 75 and 77 of FIG. 8).

Once separated from the web, the bag 91 is then filled with material through a nozzle assembly 95 that is inserted into the bag through its slit, as explained below in detail.

Figure 9D:
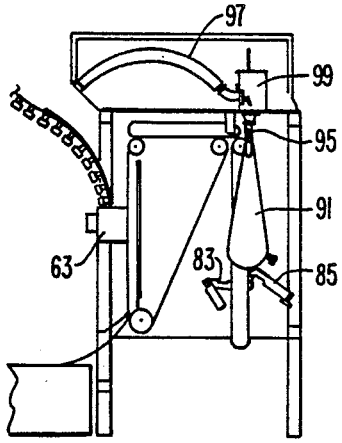
Figure 9E:
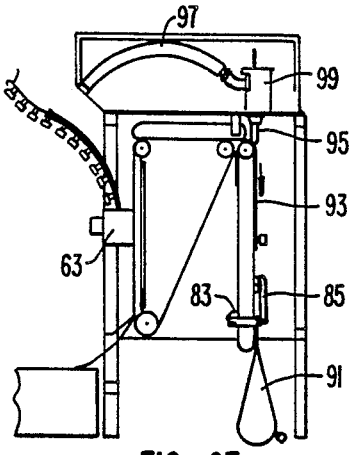

FIG. 9D shows the bag 91 having been filled with material. After filling, the bag 90 is moved by the fill tractor 31 to a lower position out of the fill station, as shown in FIG. 9E, wherein the slit in the bag is resealed and the bag is removed from the fill tractors 31.

In order to fill the bags, material is moved from a storage container (not shown) through a conduit 97 and into a housing 99 containing the mechanism that operates the fill nozzle 95. A mechanism for assuring insertion of the nozzle 95 into the bag, and for then filling that bag, will now be explained.

Referring to FIGS. 3–7, the mechanisms within the housing 99, mounted on a plate 101, for manipulating the nozzle 95 will be explained. Nozzle 95 is attached to a driving gear 103 at an upper end that is opposite from a tapered end 105 that is designed to enter the bags. That nozzle structure is carried by a support housing 107 by extending through a middle aperture 109 thereof. Rigidly attached to the support 107 is an internally threaded piece 111 which is carried by a lead screw 113. The lead screw 113 is driven by a stepper motor 115 that is mounted on the plate 101. As the stepper motor 115 is operated, its rotation of the lead screw 113 causes the support housing 107 to be moved up and down. Since the bottom surface of the nozzle driving gear 103 rests on the top of the support 107, that movement causes the nozzle 95 to move up and down.

The nozzle 95 is essentially a hollow tube into which a valve is inserted. That valve assembly includes a rotary valve gate 117 at an end of a support rod 119 to which a valve driving gear 121 is attached at an opposite end thereof. This valve assembly can be rotated independently of the nozzle 95 assembly, but both are usually driven together by a long pinion gear 123. The pinion gear is rotated by a second stepper motor 125 that is carried by the plate 101. Because of the elongated nature of the pinion gear 123, the gears 103 and 121 are both driven together by it over a wide range of elevations of the nozzle 95. That is, the motor 115 adjusts the elevation of the nozzle assembly while the motor 125 independently controls its rotational position.

Figure 6A:
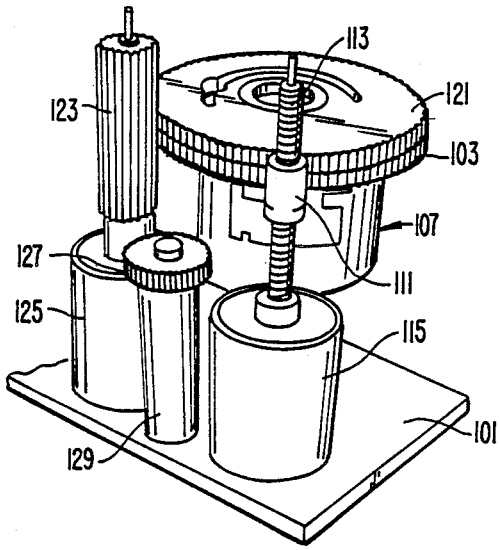
FIGS. 6A and 6B are perspective views of the filling mechanism shown in FIG. 3, but at different mechanical element positions.
Figure 6B:
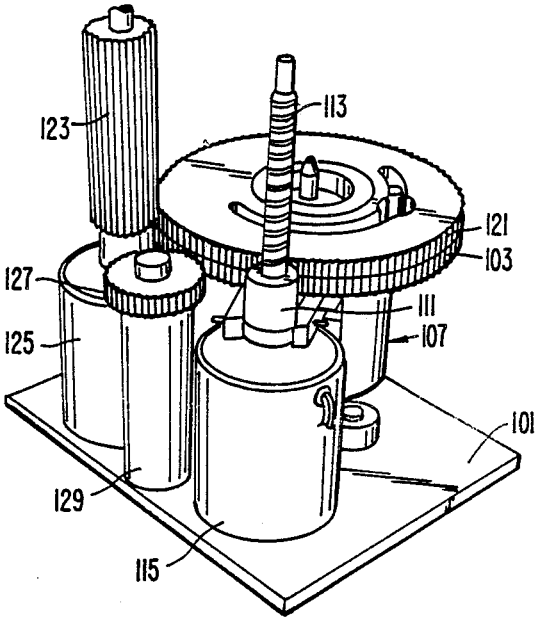

In order to rotate the valve 117 with respect to the nozzle 95, a stationary pinion gear 127 is mounted on a post 129 that is carried by the plate 101. Elevationally, the stationary gear 127 is positioned just below a bottom edge of the pinion gear 123. As best shown by FIG. 6B, this allows the valve 117 to be rotated while the nozzle 95 is held stationary. The valve 117 is rotated by the pinion gear 123 engaging and rotating the valve driving gear 121 In this extreme lower nozzle position shown in FIG. 6B, the stationary gear 127 holds the nozzle driving gear 103 against rotation. The nozzle driving gear 103 does not engage the pinion gear 123, in this position, because the gear 103 has been moved down below the lower extreme of teeth of the gear 123. When the mechanism is in this position, the nozzle 95 is being fully inserted into a bag to be filled, and the valve 117 is rotated to open and allow material to flow into the bag. That valve is subsequently closed by rotating the valve driving gear 121 in an opposite direction before the motor 115 operates to lift the entire assembly upward, and thus remove the nozzle 95 from the filled bag. FIG. 6A shows the elements in such an upward position.

Figure 7A:
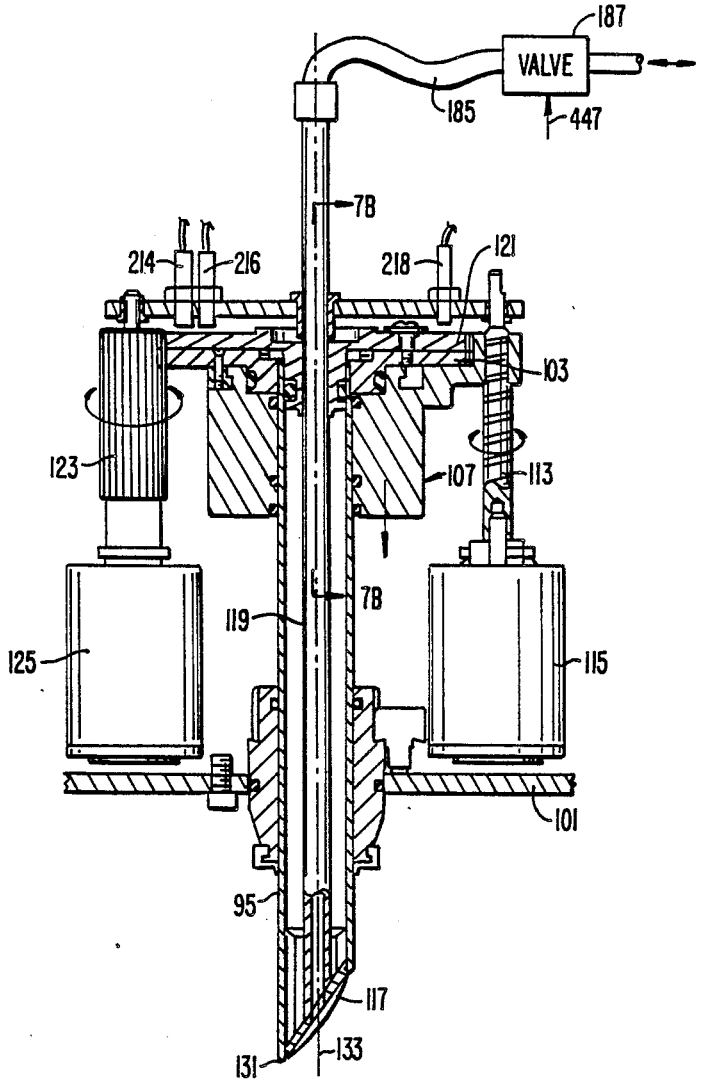
FIGS. 7A and 7B show in cross-sectional form different positions of the filling mechanism of FIGS. 3, 6A and 6B.
Figure 7B:
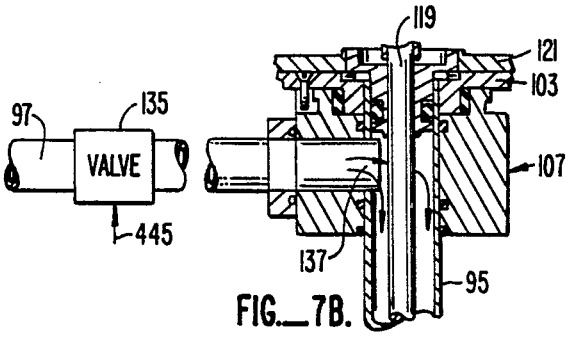

The structure and operation of the valve/nozzle assembly to fill bags with material can best be seen from FIG. 7A and 7B. The nozzle 95 is essentially a hollow tube that is gradually tapered in order to more easily fit into a bag through a narrow slit. The nozzle 95 is also cut at its lower end at a plane that forms an angle with its longitudinal axis 133, that angle being about 35° in this specific example. The nozzle has a point 131 and an opening 105 at its lower end. The valve 117 is made to fit and close off the opening 105 by attaching it to its supporting rod 119 at the same angle. Thus, the valve 117 closes off the end 131 of the nozzle 95 when in the rotatable position shown in FIG. 7A, while opening that nozzle when rotated to some other position, such as that shown in FIG. 4. This valve structure has an advantage of directing the flow of material being discharged through the nozzle 95 into a bag.

It may, in some applications, be desirable to include a second valve 135 in the path of the conduit 97, in addition to use of the valve 117. In either case, material from a supply thereof flows into the interior of the nozzle tube 95 through an opening 137, as best shown in FIG. 7B. The valve 117 may have a sealing O-ring around its outer circumference in order to closely contact the inside walls of the nozzle tube 95. This maximizes the valve operation for liquid or fine particulate material being packaged. If the material being packaged is of stringy nature, however, it can be preferable to rely on the upstream valve 135 to turn the flow of material on and off while the valve 117 is provided with sharp edges around its periphery in order to cut off any of the material that might be hanging out of the nozzle end 131 when the bag filling has terminated.

It can thus be seen that operation of the nozzle assembly and valve is accomplished by two stepper motors, 115 and 125. By energization of only those two motors, the nozzle assembly can be rotated about its vertical axis 133, can be moved up and down, and the valve 117 can be opened and closed. These motions are then put to use in order to assure that the nozzle enters each bag and controllably fills it with desired material.

Figure 4:
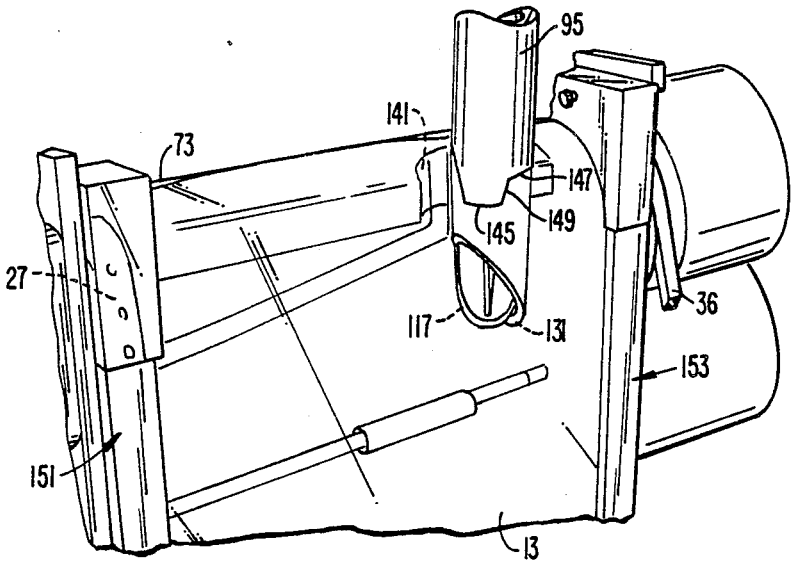
FIG. 4 is a perspective view showing use of the apparatus of FIGS. 1–3 to fill a bag.
Figure 5:
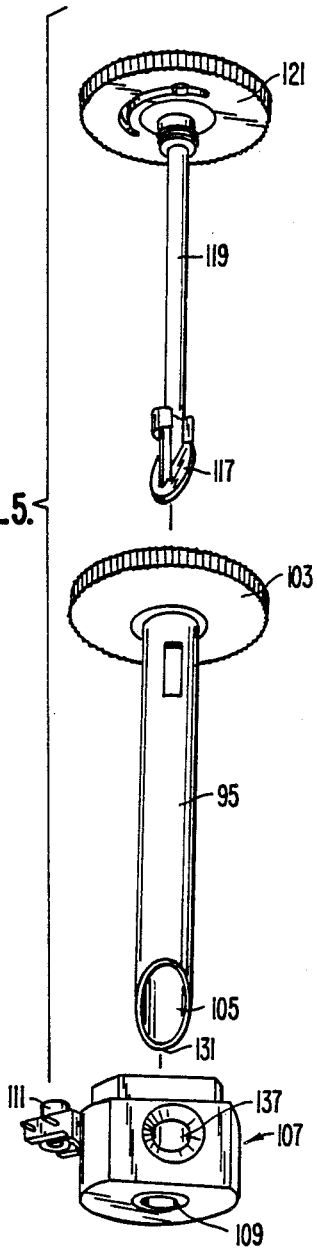
FIG. 5 is an exploded view of a portion of the filling mechanism shown in FIG. 3.

As best seen from FIGS. 3 and 4, the top bag support 73 includes a saddle indentation 141 on a vertical edge thereof that is positioned to transition the bags from a substantially horizontal position to a substantially vertical fill position. The saddle 141 is shaped to receive the nozzle 95. The bag 13 into which the nozzle 95 is being inserted is thus allowed to be deformed and pushed back into the saddle 141. This, in combination with the shape of the bag slit, the manipulation of the nozzle 95 and horizontal movement of the two driving belts 27 and 29, provide an effective, repeatable entry of the nozzle into the bags.

The bag slit is shown in dashed lines in the bag drawing of FIG. 8. It is preferred to make the cut just before filling by the kiss-cutting mechanism 71. However, in some applications where aseptic filling is not important, the cut can be alternatively formed in the bags as supplied to the filling machine in the box 11. Two horizontal slit segments 145 and 147 are displaced a distance along the length of the bag, but are joined by an intermediate slit portion 149 that extends somewhat vertically. This discontinuous shape is preferred since, when the bag is manipulated as described below prior to entry of the nozzle 95 into the slit, the partially vertical portion 149 provides a flap that is easily caught by the nozzle end point 131 as the nozzle is rotated back and forth and urged down inward through the slot.

Figure 2:
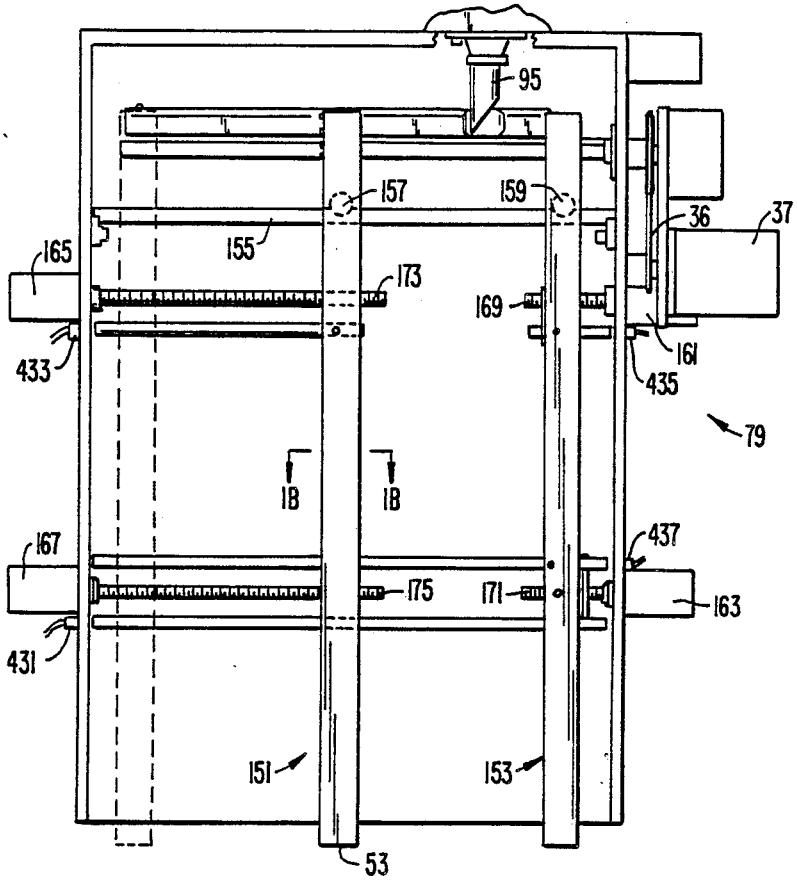
FIG. 2 is a front view of the mechanism of FIG. 1A taken at Section 2—2 thereof.

Before describing the manipulations for inserting the nozzle into the bag, a mechanism for controlling the position of the bag edges during filling is shown in FIG. 2. The bags are generally held taut across their width so that they are flat. However, in the vertical fill position, it is desirable to be able to manipulate the bag by moving its edges toward and away from each other. This can be accomplished since the bag, by this time, has been separated from the web, so its manipulation does not affect the other bags behind the bag being filled from being maintained flat.

With reference to the front view of the filling station shown in FIG. 2, a pair of vertically oriented structures 151 and 153 guide the path of the fill tractor belts 27 and 29. Their structure is shown in cross section in FIG. 1B. The weight of the guiding structures 151 and 153 is carried by a horizontal rod 155 that is attached to the frame of the machine. Rollers 157 and 159 of the structures 151 and 153, respectively, allow them to move back and forth across the rod 155. This allows the machine to be able to handle bags of different widths, such as by moving the structure 151 to the left as shown in dotted outline in FIG. 2. Once manually adjusted for a particular bag width, however, their horizontal position and angle are precisely controlled by four stepper motors 161, 163, 165 and 167. Motors 161 and 163 drive respective lead screws 169 and 171 which threadedly engage the tractor belt guide 153 near its top and bottom, respectively. Thus, by independent operation of the motors 161 and 163, the structure 153 can be tilted. By working together, the motors 161 and 163 can move the guide structure 153 a uniform horizontal distance. Thus, the right edge of the bag being filled is precisely positioned. Similarly, lead screws 173 and 175, driven by the motors 165 and 167, threadedly engage the guide structure 151 to control the position of the left edge of a bag being filled.

Use of the ability to control the positions of the edges of the bag being filled is shown in the FIGS. 10A through 10J. These diagrams shown the sequential steps of the machine operation in filling, sealing and removing the bag 13 from the machinery.

Figure 10A:
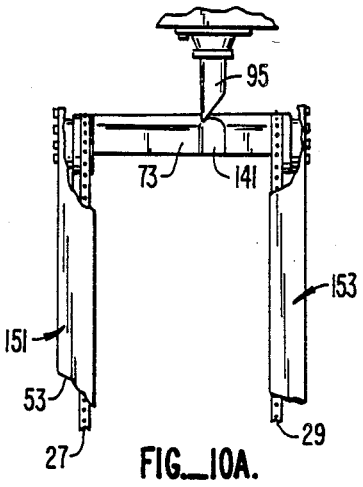
FIGS. 10A through 10J show a sequence of events in the operation of filling a bag with the illustrated apparatus from the view of FIG. 2.
Figure 10B:
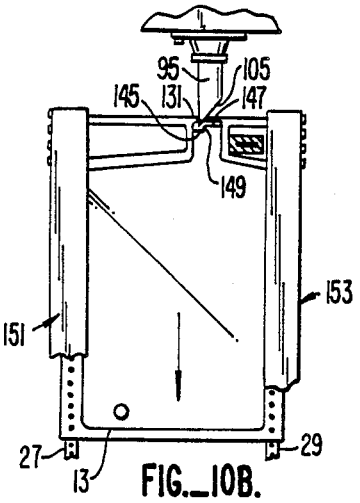
Figure 10C:
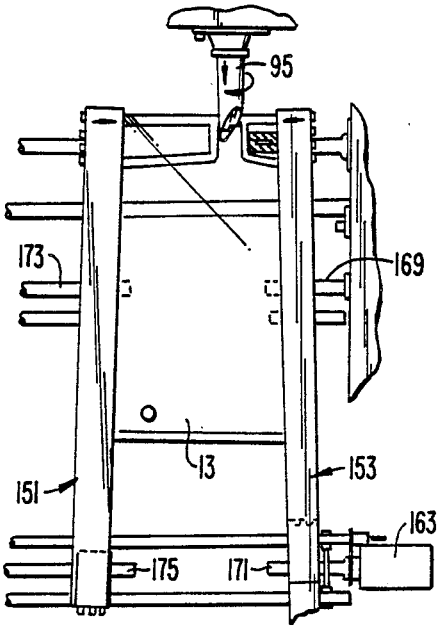

FIG. 10A schematically shows the condition of the elements, previously described primarily with respect to FIG. 2, before a fresh, flat bag 13 is moved into the fill position, as shown in FIG. 10B. The tractor belt guides 151 and 153 are initially positioned to keep the bag taut between the tractor belts 27 and 29. The bag 13 is moved by those tractor belts to the position shown in FIG. 10B wherein the tip 131 of the fill nozzle 95 is located a very short distance above the segment 145 of the slit that has been placed into the top sheet of the bag 13. The rotational position of the nozzle 95, as shown in FIG. 10B is such that its tapered, sloping end portion around the opening 105 is facing the portion 149 of the bag slit that forms a flap. It is that flap which is to be caught by the tapered end of the nozzle 95 in order that the nozzle easily enters the bag for filling it with material.

Figure 10D:
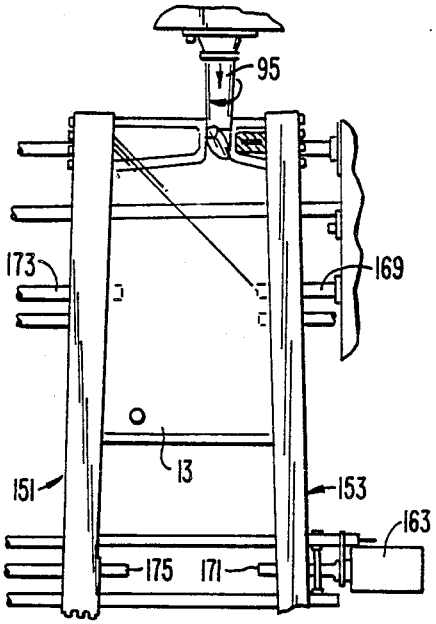
Figure 10E:
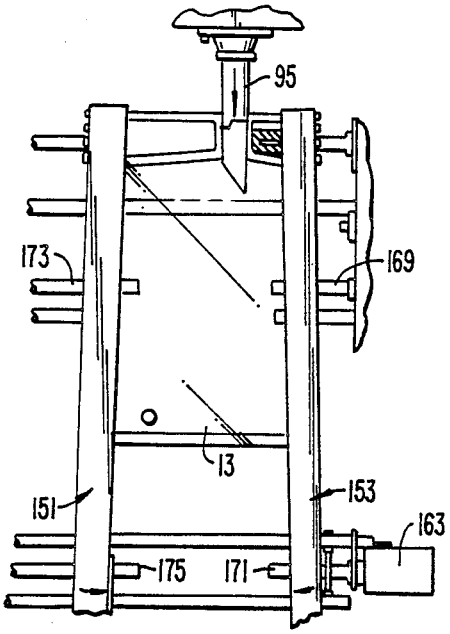

The first thing that happens is for the edges of the bag 13 at its top to be drawn together in order to give the bag some slack, this being accomplished by causing the lead screws 169 and 173 to be rotated by their driving motors. After this slackening has commenced, the nozzle 95 is rotated in the manner shown so that its tip 131 gets under the flap in the bag slit. This is aided by the bag being slackened. As the nozzle 95 is moved downward, it pushes the back, unslit sheet of the bag backwards into the saddle 141 and thus causes the bag slit flap to protrude even more. Preferably, the amount of slack given the bag top at this stage of the process is limited so that the top is again taut once the nozzle has entered it. FIG. 10D shows the nozzle 95 being rotated and urged downward even further into the bag while the position of the tractor belt guiding structures 151 and 153 remains the same. FIG. 10E shows the nozzle fully inserted into the bag 13, the guide structures 151 and 153 also remaining unchanged. Throughout this process of inserting the nozzle into the bag, the lower portion of the bag 31 preferably remains substantially taut.

Figure 10F:
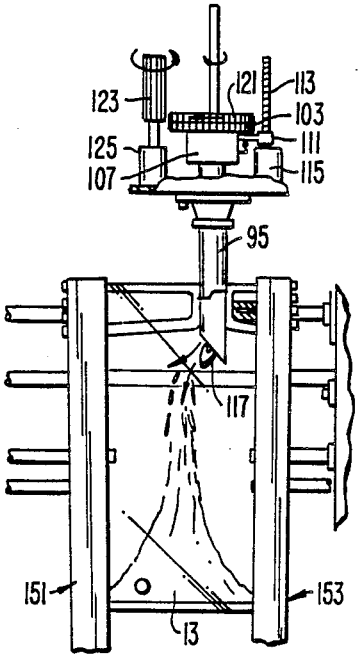
Figure 10G:
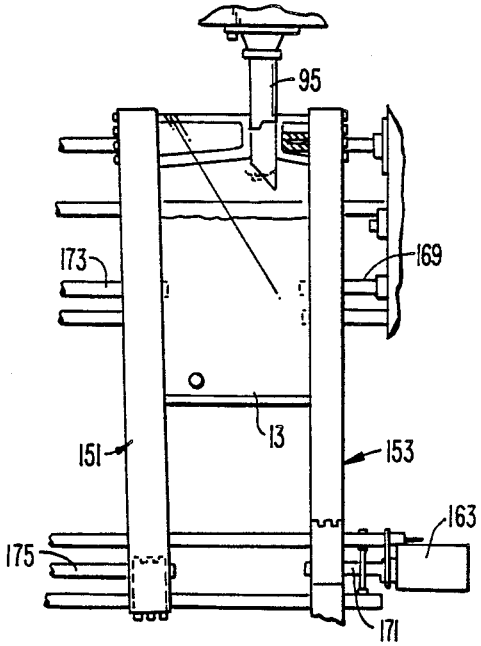

The nozzle 95 has been moved downward and rotated by energization of the two motors 115 and 125 to drive the gearing system in the manner described previously. Once the nozzle 95 is fully inserted into the bag 13, this drive gear mechanism is at its lower position described with respect to FIG. 6B and also indicated in FIG. 10F. Operation of the motor 125 then opens the valve in order to allow material to flow into the bag, and this is what is indicated in the step of FIG. 10F. At or slightly before the time that this filling commences, however, the edges of the bag 13 at its bottom are moved together by operation of the lead screws 171 and 175. This is necessary in order to give slack between the sheets of the bag which will hold the material being loaded into it. The top portion of the bag remains unchanged. This condition of the edges of the bag remains until the bag is filled, at which time the valve 117 is closed by energizing the motor 125 to rotate in an opposite direction from that when the valve was opened. FIG. 10G shows the bag having been filled and the valve 117 having just been closed.

Figure 10H:
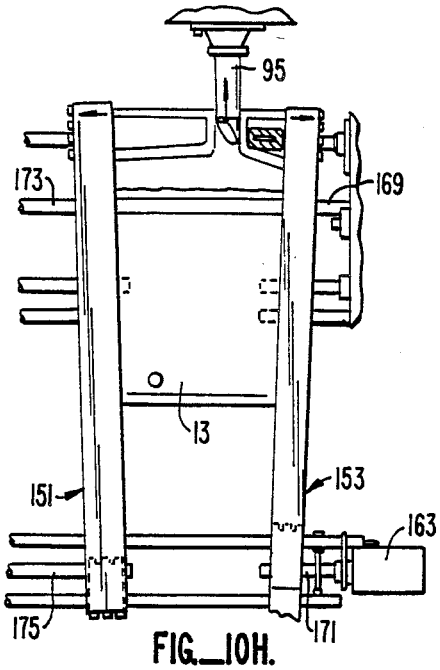
Figure 10I:
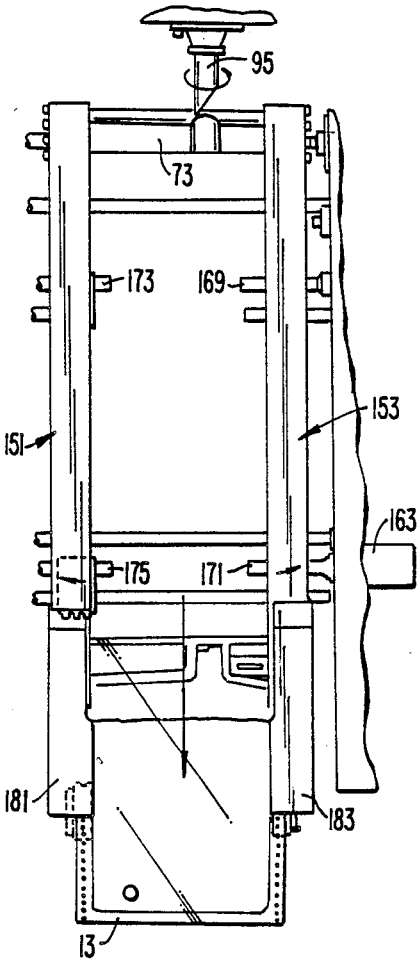

The next step, shown in FIG. 10H, is to remove the nozzle 95 from the bag, and this is accomplished by moving it directly upward, rotation of it not usually being required. This is indicated in FIG. 10H. As the nozzle is being withdrawn, the drawing of the sides of the bag apart at its top is commenced and continued until the bag top is again taut and the slit flap closed after the nozzle has been fully withdrawn. Once the nozzle 95 has been removed and the top of the bag made taut, the bag 13 is advanced to a lower position by energizing the motor 37 to move the two belts 27 and 29. FIG. 10I shows the filled bag 13 removed from the filling position.

Figure 10J:
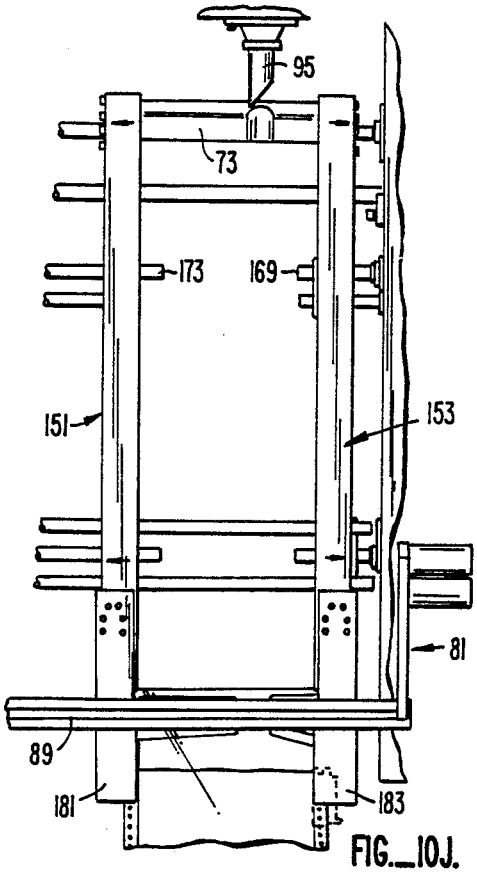
Figure 14:
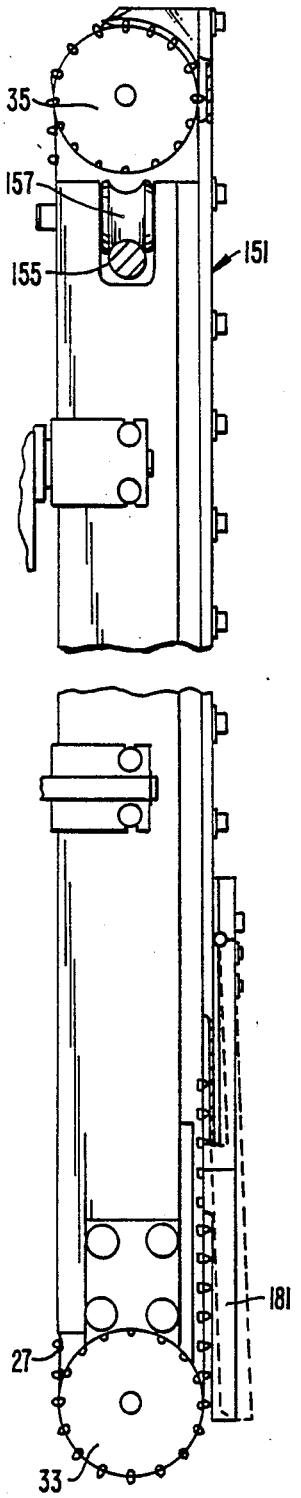
FIG. 14 is a more detailed view of a portion of the mechanism shown in FIG. 1A.

The next step, indicated in FIG. 10J, is for the bag to be gripped across its top over the portion where the slit has been formed, by compression between the arms 87 and 89. These arms contain a mechanism for wiping and sealing the slot, as described hereinafter with respect to FIGS. 15A, 15B and 15C. After that, or at the same time, the bag is moved off of the toothed belts 27 and 29 by an outward movement of both arms 83 and 85. This pushes outward lower portions 181 and 183 of a front section of the belt guides 151 and 153, respectively, and thus allows the bag to be disengaged from the toothed belts. FIG. 14 shows a side view of that mechanism, it being rotated out away from the toothed belts being shown in dotted outline. The filled bag is then removed for storage or shipping.

Figure 11A:
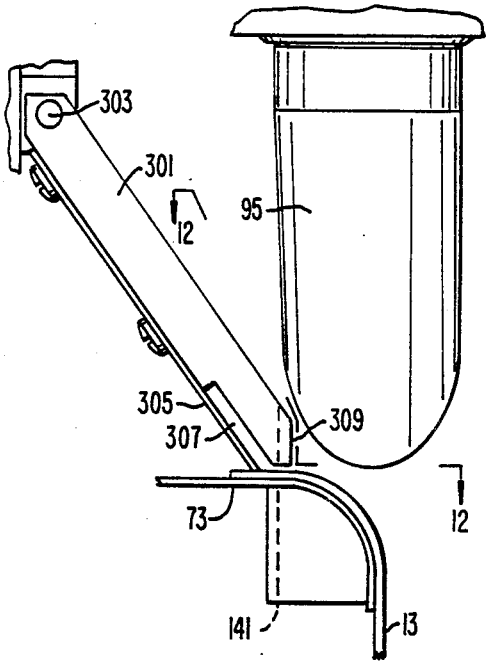
FIGS. 11A and 11B show in side view an optional mechanism for holding the top of a bag against the downward movement of a filling nozzle.
Figure 11B:
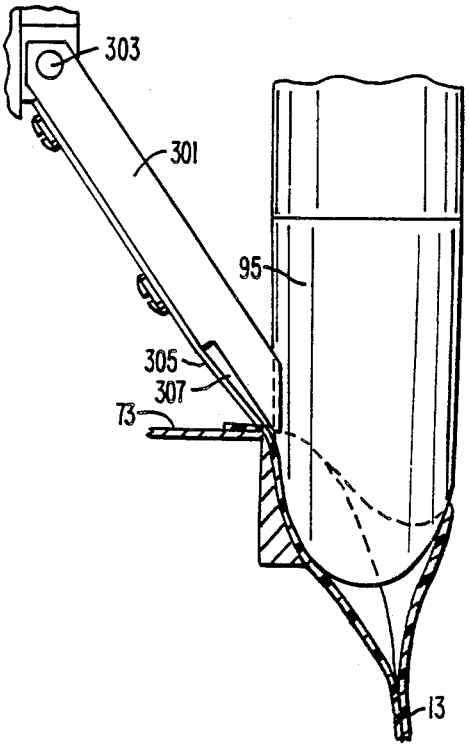
Figure 12:
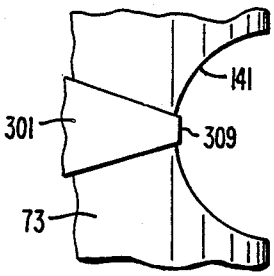
FIG. 12 shows a top view of the mechanism of FIGS. 11A and 11B.

One of the advantages of being able to control the tension across the top of the bag during filling is that it can be maintained taut enough as the nozzle attempts to enter its slit so that the bag is not pushed downward by the nozzle. If the bag top is pushed down by nozzle, it is likely not to be able to properly enter the bag through the slit. However, for wide bags, it is preferable to assist holding the bag top by use of a further gripping mechanism as shown in FIGS. 11A, 11B and 12. A rigid piece 301 is pivotally held at a pivot 303 to a frame of the machine. The piece 301 has a flexible, resilient sheet metal layer 305 attached to its underside. A notch 307 is provided at a lower end of the rigid piece 301, between it and the flexible sheet metal piece 305.

As can be seen best from FIG. 11B, the nozzle 95 contacts an end 309 of the piece 301, when the nozzle 95 is moved downward and begins to enter the slit of the bag 13. The length of the piece 301 is chosen so that it is urged downward by the nozzle 95 when so contacted. A free end of the flexible sheet material 305 then is urged downward against the bag 13 to hold it against the surface 73. Thus, the bag is held at one location adjacent the nozzle, where it needs the support the most, while the nozzle 95 is tending to push the bag 13 downward.

The structure and operation of the ends 87 and 89 of the clamping arms 83 and 85, respectively, will now be explained with respect to FIGS. 15A, 15B and 15C. The mechanism in the end portion 87 of the arm 83 functions for each bag to squeegee liquid from its surfaces in the vicinity of its slit, followed by sealing the slit by application of heat and pressure, and then cooling the bag in the region of the slit. This is accomplished by the mechanism in the arm end 87 by pushing against the end surface 89 of the arm 85, with the bag 13 gripped tightly between them.

Figure 15A:
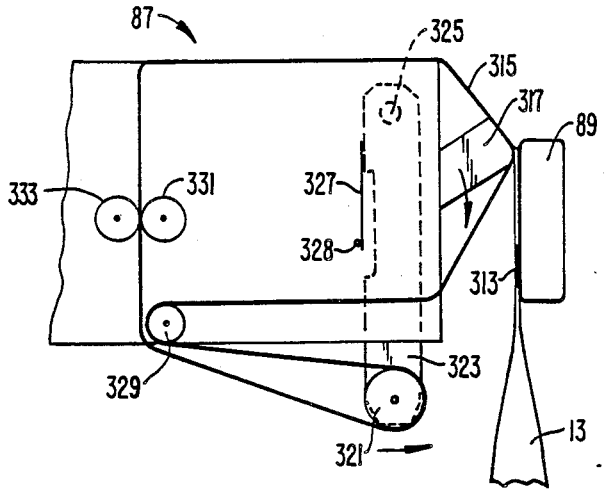
FIGS. 15A, 15B and 15C show different operational conditions of a bag resealing apparatus used in the mechanism as shown in FIG. 1A.
Figure 15B:
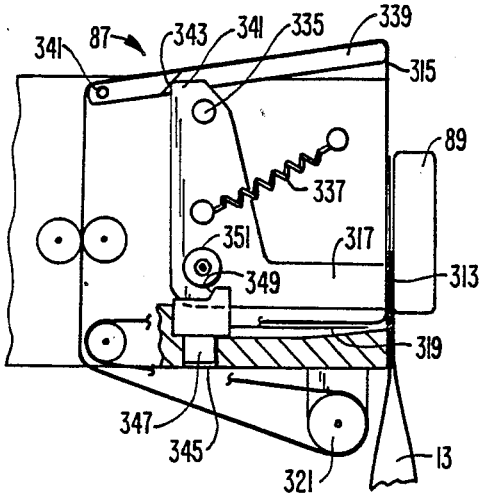
Figure 15C:
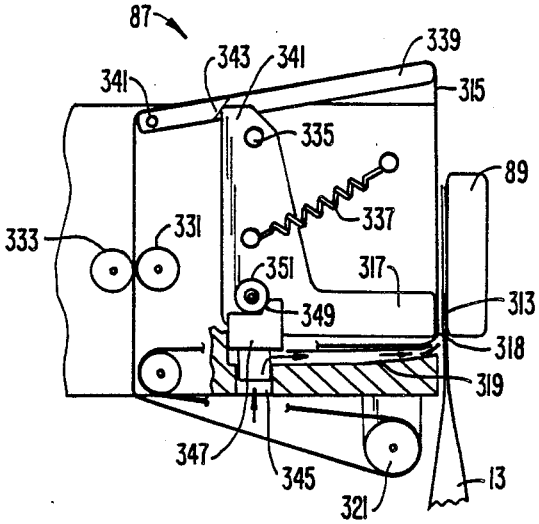

The preferred structure for the mechanism of the end 87 is schematically shown in each of FIGS. 15A, 15B and 15C, to accomplish the above-listed three purposes. FIG. 15A shows a starting position as the arms 83 and 85 are moved together. A bag 13 which has just been filled is stopped by the tractors 27 and 29 (not shown in FIG. 15) so that the top of the bag is positioned along the end piece 89 with its slit, indicated to lie in a region 313, on the side of the bag 13 that is facing an outward surface of the end piece 89.

At the time that the bag 13 and the end piece 89 have been so positioned, the end piece 87 first contacts the bag 13, as shown in FIG. 15A, by being moved toward the bag by its arm 83. An endless belt 315 of very low friction, preferably made of Teflon, is carried by the end piece 87. An arm 317 is carried within the path of the belt 315 and aids in defining its path. As the end piece 87 is moved closer to the end piece 89, as it approaches the position shown in FIG. 15B, the arm 317 operates to perform its first function without any other motor source. It wipes down along the bag 13 through the belt 315, from the bag's top to the bottom of the portion positioned against the end piece 89. Thus, a squeegee action occurs which forces liquid away from the top of the bag on both sides, and particularly away from the slit area 313, so that a good, clean seal of the slit may subsequently be accomplished.

That sealing is accomplished by providing an electrically driven heater in the end of the arm 317. The heater is controlled to remain at a constant temperature. The wiping action of the bag is accomplished rather rapidly as the end piece 87 is moved from its position shown in FIG. 15A to that shown in FIG. 15B. The arm 317 then is automatically positioned opposite the slit area 313 of the bag 13. The apparatus is then allowed to dwell in the position shown in FIG. 15B for several seconds until sufficient heat has been imparted to the bag 313 in order to melt the plastic layers together around the slit in the region 313.

The next operation, shown in FIG. 15C, is for the arm 317 to be withdrawn a small distance from the bag 313 without withdrawing the end piece 87 from the end piece 89. A gap 313 is thus formed, through which air or some other gas is directed from a passage 319 for cooling the bag 13. After a second or two of cooling, the bag 13 can be removed from its tractors 27 and 29 by simultaneous movement of the arms 83 and 85, as previously described.

The structure of the mechanism for the end 87 will now be described in more detail. The continuous low friction belt 315 is, for this specific example, in the region of from 2–3 inches wide (in a direction perpendicular to the drawings). A tensioning roller 321 is rotatedly mounted to one end of a rod 323, the other end of which is pivotally mounted at a point 325 to the body of the end piece 87. A leaf spring 327 is attached at one end to the rod 323 and is abutted at another end against a pin 328. This resilient element urges the roller 321 in a direction to take up any slack in the belt 315. Another roller 329 is provided for guiding the belt 315 to substantially change its direction. Other guiding elements for the path of the belt 315 are preferably polished metal surfaces, such as at corners, over which such a belt can easily slide. The belt 315 is held fixed with respect to the frame of the end piece 87 by being pinched between a high surface friction rubber roller 331 and a wheel 333 having a sand-like grit surface. The wheel 333 is driven by a motor (not shown) for periodically advancing the belt 315 to present a fresh length for use in the region where it is subjected to frictional wear and heat from the arm 317.

The arm 317 is generally a "L" shape and is pivotally mounted at a point 335 to the frame of the end piece 87. A resilient element 337 tends to urge the arm 317 toward its initial position shown in FIG. 15A.

As the end of the arm 317 wipes downward along the bag 13 (as the end piece 87 to moved toward the end piece 89), it is desirable that the belt 315 move as little as possible with respect to the bag 13. It is preferable that there by no relative motion between the bag 13 and the belt 315, the squeegee action occurring as the arm 317 wipes downward on the inside of the belt 315. In order to approach that goal, a second arm 339 is pivotally attached at a point 341 at one end thereof to the frame of the end piece 87. The arm 339 serves as a path guide for the belt 315. Slack in the belt 315 that naturally results as the arm 317 withdraws into the mechanism as it moved from the position of FIG. 15A to that of FIG. 15B is partially taken up by moving the arm 339 outward. This motion is preferably accomplished in direct response to the movement of the L-shaped arm 317, by providing a cam surface 341 on an end of the arm 317 near its pivot point 335, and a cam follower surface 343 on the arm 339. The arm 339 will retract upon force of the continuous belt 315 as soon as the arm 317 is moved outward of the mechanism by the force of the spring 337 when the end pieces 87 and 89 are separated from one another after a single bag heat sealing operation.

As shown in FIGS. 15B and 15C, a single pneumatic system both moves the arm 317 away from the bag 13 after heat sealing and directs air or other gas to the passage 319 into the resulting gap 318 in order to cool the heat sealed area. This is accomplished by providing a pneumatic inlet 345 to the frame of the end piece 87. Within that inlet is a piston element 347 that is sealed to the wall of the inlet 345 but movable with respect thereto. At an inside end of the piston member 347 is a cam surface 349 that is positioned to engage a roller 351 as a cam follower. The roller 351 is pivotally attached to the arm 337.

Thus, when pneumatic pressure is applied through the opening 345, the piston is moved inward against the cam follower 351, causing the arm 317 to rotate slightly about the pivot 335 in order to create the gap 318, as shown in FIG. 15C. At the same time, the passage 345 is opened into the passage 319 so that a portion of the air or other gas entering the opening 345 will pass through the passage 319 and into the gap 318 adjacent the bag seal area 313. The passage 319 is normally closed off by the piston 47 which is resiliently urged (by means not shown) toward its seated position shown in FIG. 15B. Air is preferably used to move the piston 347, but some other gas such as nitrogen will be preferable in an aseptic version of the sealing apparatus being described.

Referring again to FIG. 7A an additional option for operation during bag filling is illustrated. The valve supporting stem 119 can be made hollow, as shown in the drawing, and an opening provided from it through the valve 117. This then provides a path for removal of gas or steam from a bag when the nozzle 95 is placed in it, or the insertion of gas into the bag is made possible. It is usually desired to remove the air from the bag, in order to retard spoilage for food products, and it is often desirable in some circumstances to force the air out of the bag by inserting an inert gas which can then remain in the bag. For this to be accomplished, a hose 185 is provided at an upper end of the valve stem 119. A gas valve 187 controls its connection to a vacuum, gas, or steam source, as appropriate. Steam can be inserted into the bag after filling but before withdrawal of the nozzle in order to rinse product from the nozzle and from the inside of the bag walls at the top of the filled bag.

Portions of the preferred bag structure have been touched upon, but others will now be described, with respect to FIG. 8. The rectilinearly shaped bag 13 is attached to similar bags on either side thereof, by perforations 75 and 77. The strength of this perforated connection is preferably made to be weaker in the middle than on the outside by the tractor holes. This aids in separation of the leading bag from a web of bags just before the filling operation of the separated bag. The forces which cause separation are generated by the differential motion applied between the leading bag and those behind it through the sprocket holes which are at the edge of the bag. Thus, the strongest connection should be at the edges where those forces are applied, with a much weaker connection being provided in the middle in order to avoid tearing or separation of the bags at places other than along the line of perforations between bags.

The web of bags is preferably formed from a continuous tube of thin plastic material, but can also be formed from two separate sheets. In either case, the sheets come together at welded- edge portions 43 and 45. Also, the two sheets are welded together in strips 191 and 193 at each end of the bag, in which the respective line of perforations 75 and 77 are formed. Corner welds 195 and 197 are also included in order to relieve stresses at the bottom corners of the bag when filled. This reinforcement allows the bag to take on a roundish shape when filled with material.

Additional welds are provided at the top of the bag 13, as well, in order to cooperate with the filling mechanism. A restricted filling neck 199 is formed by welded regions 201 and 203 on opposite sides thereof. It is in this neck region where the slit 145–149 is formed. By constricting the point of entry of the nozzle 95, its entry through the slit is made easier since the flap formed by the vertically oriented slit edge 149 protrudes outward in a manner that is more pronounced than would occur if the slit is positioned in the middle of the bag with the welded edges removed a substantial distance from it.

The welded walls 201 and 203 of the neck portion 199 are preferably made to taper toward each other along the length of the neck as it opens into the main portion of the bag, as shown in FIG. 8. The amount of taper preferably matches that of the nozzle 95 so that an air tight seal is formed when the nozzle is inserted into the-bag neck. A tight fit assists in preventing air or other gases from outside the bag from entering during the filling operation. Since the two sheets of the bag are held together up until the time it is filled, there is no substantial amount of air or other gas in the bag prior to filling.

An additional pair of welds 205 and 207 are preferably added between the sheets of the bag, as well. These welds extend from inner end of respective neck walls 201 and 203 and extend away from the neck 199 to the edge welds 43 and 45, respectively. The welds 205 and 207 are preferably tapered downward into the main portion of the bag as they proceed from the neck 199 to the side weld. in those cases where the nozzle does not fully seal with the neck portion 199

The machinery being illustrated is preferably automated as much as possible, as with all industrial machinery. As part of this automation, a registration mark 209 is provided on each bag within the web at the same location. Conveniently, this mark is applied to each bag in an unused portion thereof, between various welds. The registration mark 209, in order to be visible with an otherwise clear bag, is surrounded by a dark, opaque area 211. If the bag itself is opaque, on the other hand, the mark 209 can take the form of a hole through the bag. These forms of a registration mark lend themselves to optical detection.

Such optical detectors are provided at various locations of the machine. For example, a sensor 213 can be provided at the bag feed station, and a sensor 215 at the bag slitting station. This allows the control system to detect the existence of and position of the individual bags and web of bags. Additional sensors are obviously desirable, such as sensors 217 and 219 (FIG. 1A), which monitor the feed tractor and fill tractor belts, respectively, by detecting each tooth that passes by it. Sensors 214, 216 and 218 (FIG. 7A) detect the rotational positions of the driving gears 103 and 121, as well as their elevational position relative to the base plate 101 but preferably are chosen to be of an inductive proximity type.

When a dispenser is desired to be attached to a bag as part of the filling process, a complete dispenser, or just a fitment into which a dispenser can later be installed, is attached to each bag. A preferred way of providing a supply of dispensers 67 to the filling machine of FIG. 1A is better shown FIGS. 11A and 11B. A flexible plastic carrier 69 has a large number of fitments attached to it, such as a fitment 221. It is usually preferable to have a dispenser 223 installed in the fitment 221, for maximum automation, but the fitment could be later installed. The important thing to accomplish as part of the bag filling process is to attach a fitment to each bag's outside surface without puncturing the bag. The dispenser 223 is preferably of a typical design that punctures the bag when first used to dispense liquid or other material from the filled bag. However, the same process and machinery can alternatively be employed to attach a non-piercing dispenser over a hole that is prepunched in the bag.

The fitment 221 extends through a hole of the carrier 69 and terminates in a thin plastic flange 225 on an opposite of the carrier 69. The fitment 221 is firmly attached to the carrier 69, preferably by a heat weld, adhesive or other form of attachment between the flange 225 and the carrier 69 at its common surfaces. It is the bottom of the flange 225 that is attached, by heat welding or with use of an adhesive, to a surface of the bag by the fitment attachment mechanism 63. The fitment is made detachable from the carrier 69 by perforations 227 in a circle coincident with an outer circumference of the flange 225. Those perforations are preferably stronger at 45° locations, as indicated in FIG. 11B, than in the rest of the circle. A fitment is then removed from the carrier 69 by punching out the portion of the carrier 69 within the perforations 227. This carrier portion remains with the fitment as it is attached to a bag.

The carrier 69 also preferably contains sprocket holes along each edge thereof, such as sprocket holes 229, so that a long length of carrier 69 with a large number of fitments attached to it may be positively advanced from a supply box 65 (FIG. 1A) and into the fitment attachment mechanism 63. The driving wheel 70 contains outwardly extending teeth in a pattern that matches the holes along the edge of the carrier 69.

Figure 16:
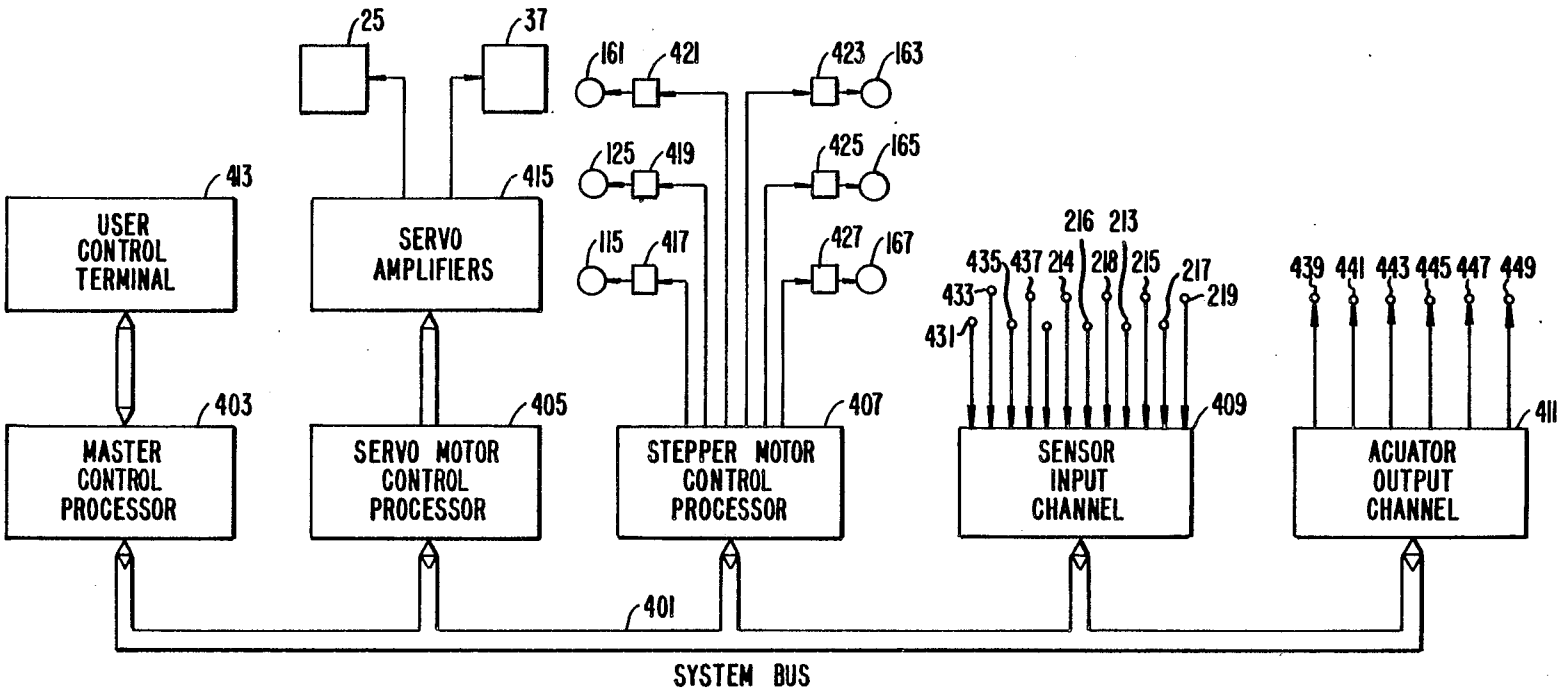
FIG. 16 is a block electrical diagram of a control system for the apparatus illustrated in the foregoing Figures.

Referring to FIG. 16, an electronic system is shown for controlling the packaging machinery described above. Connected to a single system bus 401, conveniently conforming to the STD BUS standard, are several control processing circuits 403, 405 and 407, and input/output channels 409 and 411. Each of the processing circuits includes its own controlling microprocessor. Each of the input/output channels includes circuitry to connect sensors and actuators to the system bus 401. A master control processor 403 contains a real-time, multi-tasking software system for causing the three control processors to work together in order to carry out the operation of the packaging machinery. A control terminal 413 includes a standard CRT terminal and keyboard through which a user inputs commands and parameters to the system.

Feed tractor driving motor 25 (FIG. 1A) and fill tractor driving motor 37 are controlled by the control processor circuit 405, through usual servo amplifiers 415. Similarly, the six stepper motors described above are controlled by the control processor 407. The stepper motors 115 and 125 (FIGS. 3 and 6) which control the nozzle 95 and its internal valve 117, are controlled by stepper drivers 417 and 419, respectively. The four stepper motors 161, 163, 165 and 167 (FIG. 2), which control the spacing of the drive belt, are driven through driving circuits 421, 423, 425 and 427.

In order to verify the positions of some mechanical elements and other conditions, the various sensors described above provide their electrical signal outputs into the system through the input channel 409. The sensors 214, 216 and 218 (FIG. 7A) detect the rotational positions of the driving gears 103 and 121. Sensors 213 and 215 (FIG. 1A) detect the position of a bag at two of the machine's work stations. Sensors 217 and 219 (FIG. 1A) count the teeth of one of the driving belts as they pass the sensor. Two other sensors (not shown) are also provided for the other two belts not shown in FIG. 1A. Similarly, detectors 431, 433, 435 and 437 (FIG. 2) provide an indication of the horizontal positions of the top and bottom of the belt guides 151 and 153. Each of these sensors detect the position of an end of a rod relative to the fixed position of the sensor. Each such rod is attached to one of the guiding structures 151 and 153 by the pins shown in FIG. 2.

The filling machinery being described includes electrically controlled actuators in addition to the servo and stepper motors. These actuators are generally of a solenoid type and have their energization controlled through the output channel 411. The actuator 439 of FIG. 16, for example, operates the knife of the kiss cutting mechanism 71 (FIG. 1A). Two actuators are preferably provided to operate the arms 83 and 85 (FIG. 1A), one actuator 441 designed to move those arms together into the sealing position shown in FIG. 9E, and another actuator 443 for moving the arms 83 and 85 together in order to remove the filled bag from the tractors. An actuator 445 operates the fill material control valve 135 (FIG. 7B), if one is provided. Similarly, an actuator 447 controls the gas valve 187 (FIG. 7A). Finally, an actuator 449 opens and closes the air supply to the piston 347 (FIG. 15B) of the bag resealing mechanism 87.

The box 11 of a source of bags 13 (FIG. 1A) will, obviously, become exhausted in time, thus requiring a new supply of bags to be provided. It is preferable if the new web of bags can have its leading edge attached to the trailing edge of the web already in the machine, before the supply is exhausted. This avoids having to stop the machine's operation in order to replace the source of bags.

Figure 17A:
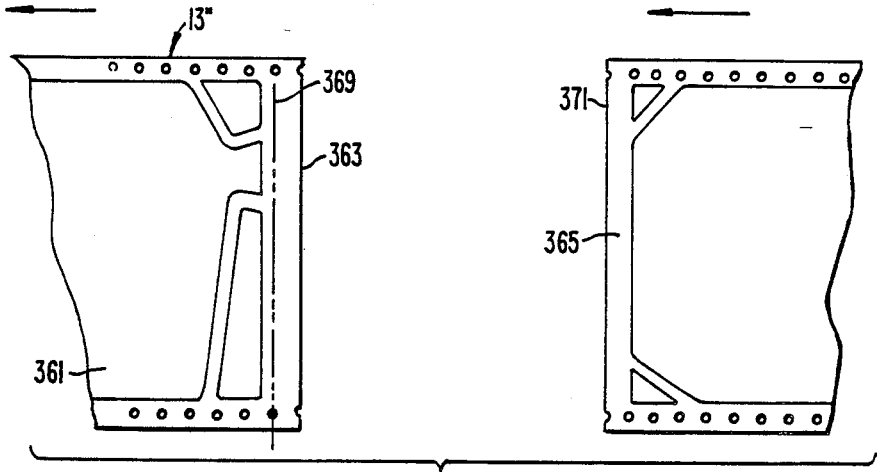
FIGS. 17A, 17B and 17C illustrate a technique for providing a continuous source of bags to the filling machine.
Figure 17B:
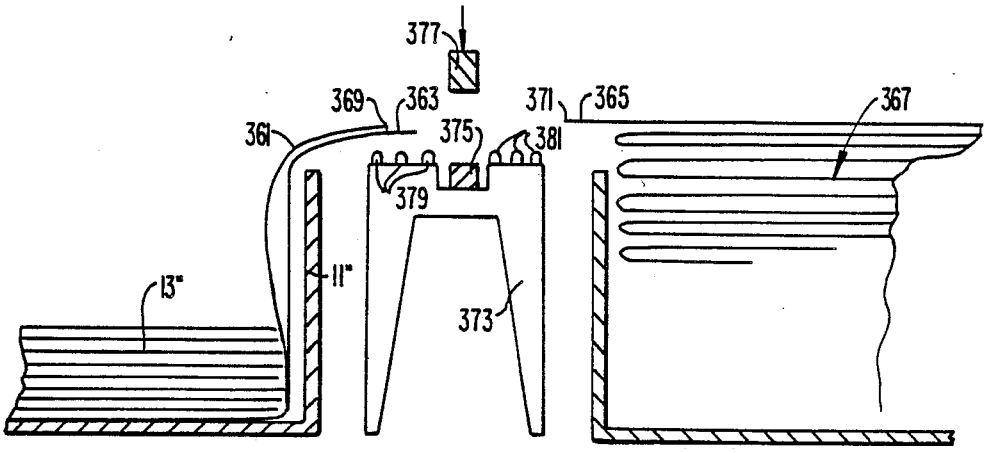
Figure 17C:
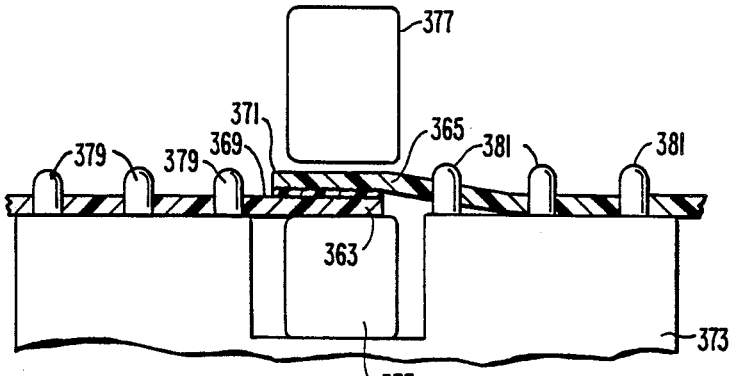

A procedure for accomplishing such continuous bag feed is illustrated in FIGS. 17A, 17B and 17C. A box 11'' of bags 13' is somewhat different than that shown in FIG. 1A in that an end bag 361 of the supply currently installed in the filling machinery is caused to extend out of the box 11'' so that the web's end 363 is free and accessible. This allows a leading edge 365 of a second supply 367 of bags to be attached to the trailing end 363 long before the current supply is exhausted. When it is exhausted, the second supply of bags 367 is then pulled into the filling machine behind the first batch 13''. The filling machine thus has a continuous supply.

A preferable way of making such an attachment is to cut the trailing end 363 of the current batch of bags so that a small distance, such as a third or one-half of an inch, of bag exists beyond the final perforation 369 across the width of the bag web. The leading edge 365 of the second supply of bags terminates along a perforation 371 across the web of bags.

In this way, the leading edge 365 can be positioned over the trailing edge 363 and the two portions bonded together. This can be accomplished as shown in FIGS. 17B and 17C. A table 373 is provided with a pair of heating, sealing bars 375 and 377. A group of alignment pins 379 allow the side holes of the last bag 361 to be positioned on the table with its end portion 363 over the stationary sealer bar 375. Thereafter, the leading edge 365 of the second batch of bags 367 is held in position on the table by a second set of alignment pins 381. The two bags overlap as shown in FIG. 17C, at which time the top sealer bar 377 is brought down to seal the bags by heat and compressive pressure.

Figure 18:
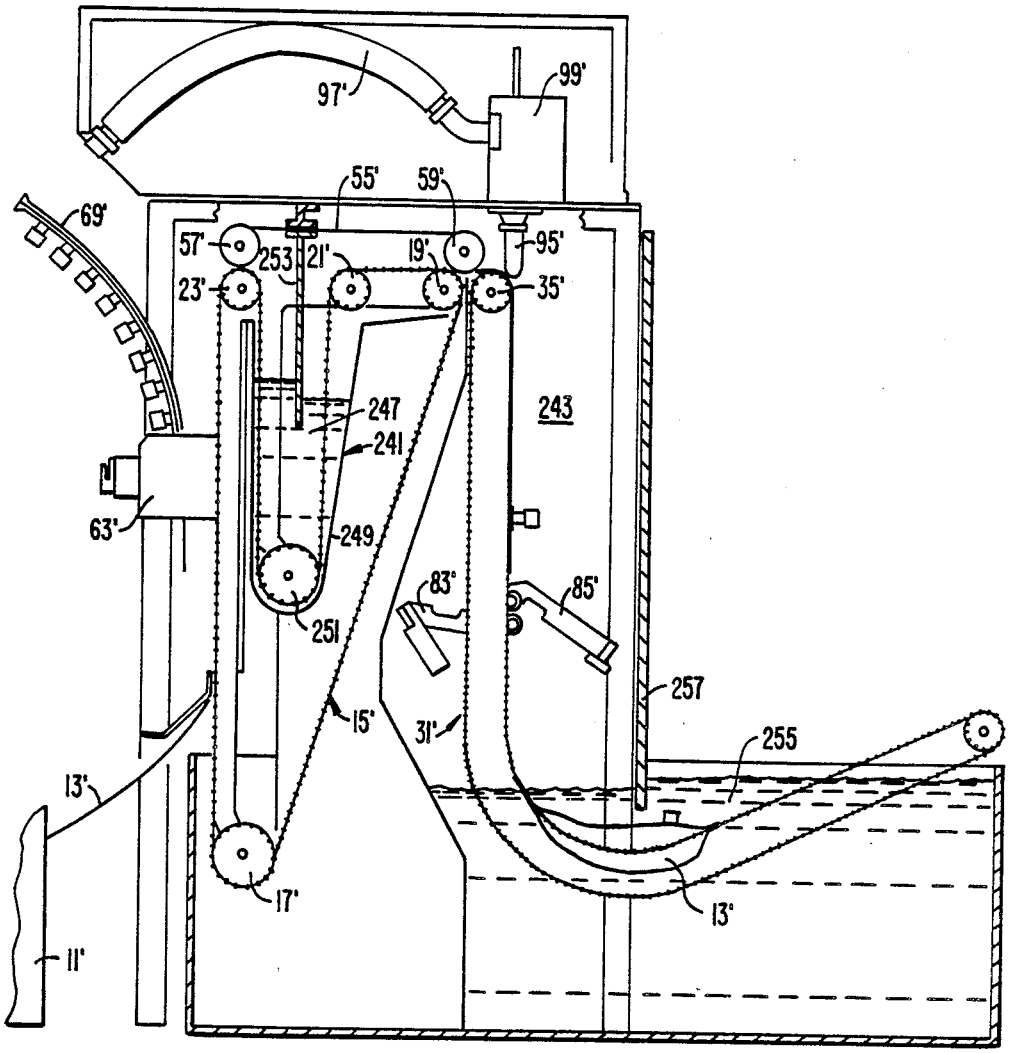
FIG. 18 shows a modification of the filling apparatus to maintain an aseptic filling environment.

The machine and techniques described so far with respect to the preferred embodiments have not paid special attention to aseptic packaging, such as is desired for low acid food and the like. A great deal of packaging does not require sterile conditions, so the complications of an aseptic system can be avoided where not necessary. FIG. 18 shows a modified version of the filling machinery described above, with aseptic containment added. FIG. 18 is generally the same view of the machinery as FIG. 1A and employs the same reference numbers for the same or equivalent parts, with a prime (') added.

The principal differences in the FIG. 18 embodiment are the addition of a liquid sterilant 247 at an entrance to an aseptic containment portion 243 of the filling machinery, and an exit liquid bath 255. The inlet sterilant bath of liquid 247 is carried by a container 249. A set of idler pulley wheels 251 is provided at the bottom of the container 249 in order to route the feed tractor 15' and containment belt 55', in order to route the bags through the liquid. Because the bags will be supplied, at least in this aseptic version, without any openings in them, they can be made to be sterile on the inside, so the solution 247 can be selected as appropriate for sterilizing the outside of the bags and their attached fitments. A baffle 253 extends from a top enclosure of the aseptic portion 243 and into the liquid 247. The difference in the level of the liquid 247 on either side of the baffle is due to increased pressurization of the aseptic containment portion 243 in order to avoid entry of undesired contaminants.

At the exit portion of the machine, the bag 13' is passed through a liquid 255 into which an exterior baffle 257 of the aseptic containment portion 243 extends. Rather than removing the bag at the sealing station, as done in the embodiment described with respect to FIG. 1A, the bag 13, remains on the fill tractor until carried by an extended version of it through the liquid bath 255 and out of the machine. Some aid to keeping the bag 13, on the tooted belts after being resealed may be necessary, such as by using a retaining belt of the type shown in FIG. 1C and indicated at 55.

Although the several aspects of the present invention have been described with respect to preferred embodiments thereof, it will be understood that the invention is entitled to protection within the full scope of the following claims.

It is claimed:

1. In a continuous web of a plurality of rectangularly shaped flat flexible plastic bags wherein each such bag has front and back sheets joined together along four edges thereof to form a pocket between the sheets which can be filled with material, a first pair of opposite bag edges extending along the length of the web and containing sprocket holes periodically spaced therealong and a second pair of opposite bag edges extending across the width of the web having perforations thereacross which connect the bag to those on either side thereof along the length of the web, the improvements comprising regions of attachment of the bag sheets together intermediate of said first pair of opposite edges and adjacent one of the second pair of edges but extending away therefrom a certain distance much less than that between the second pair of bag edges in a manner to form a neck between said regions wherein the bag sheets are unattached with each other and the neck opens to the interior of the bag, and regions of attachment of the bag sheets together across corners formed at an intersection of the first pair of edges and another of the second pair of edges.

2. In a continuous web of a plurality of rectangularly shaped flat flexible plastic bags wherein each such bag has front and back sheets joined together along four edges thereof to form a pocket between the sheets which can be filled with material, a first pair of opposite bag edges extending along the length of the web and containing sprocket holes periodically spaced therealong and a second pair of opposite bag edges extending across the width of the web having perforations thereacross in a region which connects the bag to those on either side thereof along the length of the web, the improvement comprising regions of attachment of the bag sheets together intermediate of said first pair of opposite edges and adjacent one of the second pair of edges but extending away therefrom a certain distance much less than that between the second pair of bag edges in a manner to form a neck between said regions wherein the bag sheets are unattached with each other and the neck opens to the interior of the bag, and wherein the perforated connections at adjoining edges between adjacent bags are characterized by being stronger adjacent said first pair of edges than therebetween.

3. The web of bags according to either of claims 1 or 2 wherein the improvement additionally comprises a machine readable mark positioned on each bag in an area between the neck portion and one of the first pair of bag edges.

4. The web of bags according to either of claims 1 or 2 wherein the improvement additionally comprises said regions of attachment of the bag sheets together being formed to shape said neck to become gradually smaller as a function of distance from said one edge of the second pair.

5. The web of bags according to either of claims 1 or 2 wherein the improvement additionally comprises further regions of attachment of the bag sheets together that extend from an inward extent of the neck regions of attachment to one of the first pair of edges and in a path proceeding inward of the bag as the further attachment regions move away from said neck.

6. A liquid containing bag, comprising:

a pair of flexible sheets of weldable material attached together on opposite edges, said sheets being welded together in at least two strips extending in a path across the width of the bag between the opposite edges and spaced apart from each other in a manner that one such weld defines the top of the bag and the other the bottom, thereby to form a liquid holding pouch bounded by said opposite edges and said welded strips, a liquid filling passage formed by a pair of welds continuous with the top welded strip and extending into the sealed pouch a portion of the distance toward the bottom welded strip, said passage welds having space between them to form a neck that opens directly into the bag pouch, a slit formed through one of the bag sheets in the neck liquid filling passage while the other sheet remains unperforated in the neck region, said pouch having been filled with liquid through said slit, and an additional weld of the sheets together across said neck to join the pair of liquid passage forming welds and thereby to seal the liquid filled bag.

7. The liquid containing bag according to claim 6 which additionally includes welds across corners formed by an intersection of the bottom weld with said opposite edges.

8. The liquid containing bag according to claim 6 wherein the pair of welds forming the liquid filling passage are shaped in a manner that the neck narrows as a function of distance away from the top weld.

9. The liquid containing bag according to claim 6 wherein the pair of welds forming the liquid filling passage are shaped in a manner that the neck narrows as a function of distance away from the top weld, and which further comprises additional welds of the sheets that extend in a path from an end of each of the pair of welds forming the liquid filling passage and across to the closest of the opposite edges with a slope downward away from the top welded strip.

10. The liquid containing bag according to any one of claims 6–9, inclusive, wherein the liquid within the bag includes a food or beverage product intended for human consumption.

11. A flat, rectangularly shaped bag adapted to be filled with fluid material, comprising:

a pair of flexible sheets of weldable material attached together on opposite edges, said sheets being welded together in at least two strips extending in a path across the width of the bag between said opposite edges and spaced apart from each other in a manner that one such weld defines the top of the bag and the other the bottom, thereby to form a fully sealed material holding pouch bounded by said opposite edges and said welded strips, a fluid material filling passage formed by a pair of welds continuous with the top welded strip and extending into the sealed pouch with spaced between them to form a neck that opens directly into the bag pouch, said pair of fluid material filling passage welds being shaped in a manner that the resulting neck narrows as a function of distance away from the top weld, whereby the filling neck can be utilized by forming an opening thereinto through one of the sheets, and additional welds of the sheets that extend in paths from each of the pair of fluid material filling passage welds at substantially their ends and across to the closest of the opposite edges.

12. A flat, rectangularly shaped bag adapted to be filled with fluid material, comprising:

a pair of flexible sheets of weldable material attached together on opposite edges, said sheets being welded together in at least two strips extending in a path across the width of the bag between said opposite edges and spaced apart from each other in a manner that one such weld defines the top of the bag and the other the bottom, thereby to form a material holding pouch bounded by said opposite edges and said welded strips, a fluid material filling passage formed by a pair of welds continuous with the top welded strip and extending into the sealed pouch a portion of the distance to said bottom weld strip, said passage forming welds having a space between them to form a neck that opens directly into the bag pouch, and a slit formed through one of the bag sheets in the liquid filling passage neck while the other sheet remains unperforated in the neck region, whereby the material holding pouch may be filled by inserting a filling nozzle into the neck through the slit.

13. The combination according to claim 12 wherein the pair of welds forming the material filling passage are shaped in a manner that the neck narrows as a function of distance away from the top weld.

14. The combination according to claim 12 wherein the pair of welds forming the material filling passage are shaped in a manner that the neck narrows as a function of distance away from the top weld, and which further comprises additional welds of the sheets that extend in a path from substantially an end of each of the pair of welds forming the material filling passage and across to the closest of the opposite edges.

15. An elongated web of a plurality of sealed bags adapted to be individually filled with fluid material, the bags individually comprising:

a pair of flexible sheets of weldable material attached together on opposite edges that form a segment of the web's outside edges extending along its length, said sheets being welded together in at least two strips extending in a path across the width of the bag between said opposite edges and spaced apart from each other in a manner that one such weld defines the top of the bag and the other the bottom, thereby to form a sealed material holding pouch bounded by said opposite edges and said welded strips, a fluid material filling passage formed by a pair of welds continuous with the top welded strip and extending into the sealed pouch with space between them to form a neck that opens directly into the bag pouch, said pair of fluid material filling passage welds being shaped in a manner that the resulting neck narrows as a function of distance away from the top weld, whereby the filling neck can be utilized by forming an opening thereinto through one of the sheets, and two additional welds of the sheets that extend in paths from each of the pair of fluid material filling passage welds at substantially their ends and across to the closest of the opposite edges.

16. The combination of claim 15 which additionally comprises a line of perforations extending across the width of the bag within each of said at least two welded strips, whereby the individual bag may be separated from the web at the perforations.

17. The combination of either of claims 15 or 16 wherein said opposite bag edges include welded strips that each contain sprocket holes periodically spaced therealong.

18. The combination according to any one of claim 15, 11 or 12 wherein the opposite edges of the sheets are additionally welded together in strips extending between the top and bottom welds.

19. The combination according to any one of claims 15, 11 or 14 wherein said additional welds are formed with a slope downward away from the top welded strip as they extend from each of the pair of neck forming welds and across to the closest of the opposite edges.

20. In a continuous web of a plurality of rectangularly shaped flat flexible plastic bags wherein each such bag has front and back sheets joined together along four edges thereof to form a pocket between the sheets which can be filled with material, a first pair of opposite bag edges extending along the length of the web and containing sprocket holes periodically spaced therealong and a second pair of opposite bag edges extending across the width of the web having perforations thereacross which connect the bag to those on either side thereof along the length of the web, the improvement comprising forming said perforations such that the attachment between adjacent bags is significantly stronger near the first pair of opposite edges than therebetween.

21. In a rectangularly shaped flat flexible plastic bag which has front and back sheets joined together along four edges thereof to form a pocket between the sheets which can be filled with material, a first pair of opposite edges extending along its length and a second pair of opposite edges extending across its width, the improvement comprising:

regions of attachment of the bag sheets together intermediate of said first pair of opposite edges and adjacent one of the second pair of edges but extending away therefrom a certain distance much less than that between the second pair of bag edges, in a manner to form a neck between said regions wherein the bag sheets are unattached with each other, and a slit formed through one of the bag sheets in the neck while the other sheet remains unperforated in the neck region.

22. The improved bag according to claim 21 wherein said slit is formed of two portions oriented generally parallel with said one of the first pair of edges but displaced different distances therefrom and joined by another slit portion.

* * * * *